US007799498B2

(12) United States Patent
Seshita et al.

(10) Patent No.: US 7,799,498 B2
(45) **Date of Patent: *Sep. 21, 2010**

(54) TONER USED FOR IMAGE FORMING APPARATUS

(75) Inventors: Takuya Seshita, Hiratsuka (JP); Junichi Awamura, Numazu (JP); Tomomi Suzuki, Numazu (JP); Toyoshi Sawada, Hiratsuka (JP); Masahide Yamada, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 140 days.

This patent is subject to a terminal disclaimer.

(21) Appl. No.: 12/026,937

(22) Filed: Feb. 6, 2008

(65) Prior Publication Data

US 2008/0292361 A1 Nov. 27, 2008

(30) Foreign Application Priority Data

Mar. 2, 2007 (JP) ..... 2007-052219

(51) Int. Cl.
*G03G 15/08* (2006.01)

(52) U.S. Cl. ..... 430/108.3; 430/108.7; 430/110.3; 399/107; 399/111

(58) Field of Classification Search ..... 430/108.3, 430/108.7, 110.3; 399/107, 111
See application file for complete search history.

(56) References Cited

U.S. PATENT DOCUMENTS

| | | | | |
|---|---|---|---|---|
| 7,459,255 | B2 * | 12/2008 | Tanaka et al. | 430/110.3 |
| 2006/0046174 | A1 | 3/2006 | Ohki et al. | |
| 2006/0057488 | A1 | 3/2006 | Inoue et al. | |
| 2006/0063089 | A1 | 3/2006 | Tanaka et al. | |
| 2006/0068312 | A1 | 3/2006 | Yamashita et al. | |
| 2006/0099529 | A1 | 5/2006 | Tanaka et al. | |
| 2006/0160011 | A1 | 7/2006 | Inoue et al. | |
| 2006/0204883 | A1 | 9/2006 | Nakayama et al. | |
| 2006/0210903 | A1 | 9/2006 | Ohki et al. | |
| 2006/0251979 | A1 | 11/2006 | Watanabe et al. | |
| 2007/0059626 | A1 | 3/2007 | Inoue et al. | |
| 2007/0141506 | A1 | 6/2007 | Inoue et al. | |
| 2007/0218383 | A1 | 9/2007 | Seshita et al. | |
| 2007/0218391 | A1 | 9/2007 | Yamada et al. | |
| 2007/0218392 | A1 | 9/2007 | Yamada et al. | |
| 2008/0070148 | A1 | 3/2008 | Awamura et al. | |

FOREIGN PATENT DOCUMENTS

| | | |
|---|---|---|
| JP | 1-257857 | 10/1989 |
| JP | 4-27897 | 5/1992 |
| JP | 6-317928 | 11/1994 |
| JP | 10-142897 | 5/1998 |
| JP | 2001-117265 | 4/2001 |
| JP | 2002-55580 | 2/2002 |
| JP | 2002-156877 | 5/2002 |
| JP | 2002-229227 | 8/2002 |
| JP | 2002-244487 | 8/2002 |
| JP | 2002-244516 | 8/2002 |
| JP | 2002-287495 | 10/2002 |
| JP | 2002-307740 | 10/2002 |
| JP | 2005-17469 | 1/2005 |

OTHER PUBLICATIONS

U.S. Appl. No. 11/685,872, filed Mar. 14, 2007.*
U.S. Appl. No. 11/687,060, filed Mar. 16, 2007.*
U.S. Appl. No. 12/035,862, filed Feb. 22, 2008, Nagatomo, et al.
U.S. Appl. No. 12/042,041, filed Mar. 4, 2008, Yamada, et al.
U.S. Appl. No. 12/042,941, filed Mar. 12, 2008, Awamura, et al.
U.S. Appl. No. 12/203,278, filed Sep. 3, 2008, Yamada, et al.
U.S. Appl. No. 12/209,583, filed Sep. 12, 2008, Seshita, et al.
U.S. Appl. No. 12/260,493, filed Oct. 29, 2008, Sawada, et al.
U.S. Appl. No. 11/192,051, Final Rejection, mailed Nov. 30, 2009.
U.S. Appl. No. 11/192,051, Final Rejection, mailed Nov. 30, 2009, Final Resp, filed Jan. 13, 2010.
U.S. Appl. No. 11/224,976, Final Rejection, mailed Oct. 21, 2009.
U.S. Appl. No. 11/229,748, Final Rejection, mailed Feb. 18, 2010.
U.S. Appl. No. 11/519,893, Final Rejection, mailed Jan. 27, 2010.
U.S. Appl. No. 11/558,736, Office Action, mailed Sep. 18, 2009, OA Response, filed Dec. 8, 2009.
U.S. Appl. No. 11/687,875, 1st Office Action, mailed Feb. 4, 2010.
U.S. Appl. No. 11/685,872, 1st Office Action, mailed Feb. 1, 2010.
U.S. Appl. No. 11/687,404, Notice of Allowance, mailed Nov. 4, 2009, Issue Fee, filed Jan. 29, 2010.
U.S. Appl. No. 11/687,404, Notice of Allowance, mailed Nov. 4, 2009, Pub Fee Due, filed Jan. 29, 2010.
U.S. Appl. No. 11/855,806, Office Action, mailed Jan. 15, 2010.
U.S. Appl. No. 11/857,791, Final Rejection, mailed Jan. 21, 2010.
U.S. Appl. No. 11/854,842, Office Action, mailed Dec. 17, 2009.
U.S. Appl. No. 12/091,301, 1st Office Action, mailed Nov. 2, 2009, 1st OA Resp, filed Feb. 2, 2010.
U.S. Appl. No. 12/203,278, 1st Office Action, mailed Jan. 12, 2010.
U.S. Appl. No. 12/203,976, Notice of Allowance, mailed Dec. 3, 2009.
U.S. Appl. No. 12/212,235, Notice of Allowance, mailed Feb. 3, 2010.
U.S. Appl. No. 12/343,574, Notice of Allowance, mailed Aug. 28, 2009, Issue Fee, filed Nov. 24, 2009.
U.S. Appl. No. 12/343,574, Notice of Allowance, mailed Aug. 28, 2009, Pub Fee Due, filed Nov. 24, 2009.

* cited by examiner

*Primary Examiner*—Hoa V Le
(74) *Attorney, Agent, or Firm*—Oblon, Spivak, McClelland, Maier & Neustadt, L.L.P.

(57) ABSTRACT

The present invention provides an image forming apparatus capable of stably producing high quality images with time, without causing missing a central part of a thin line, however, with keeping an appropriate flowability of a toner. The toner used in the image forming apparatus is a toner which contains a binder resin, a colorant, and a laminar inorganic mineral in which at least part of an ion in layers is modified with an organic ion, the toner is granulated in an aqueous system, the volume average particle diameter Dv of the toner is in the range of 3.0 μm<Dv<6.5 μm, the aspect ratio of the toner is 0.81 to 0.89, and the surface of the toner is externally added with a plurality of types of fine particles.

7 Claims, 3 Drawing Sheets

TONER USED FOR IMAGE FORMING APPARATUS

BACKGROUND OF THE INVENTION

1. Field of the Invention

The present invention relates to an image forming apparatus, such as copiers and printers, and specifically relates to a toner used in an image forming apparatus having at least an image bearing member, a charging unit, a developing unit, a transfer unit, a cleaning unit, a lubricant applying unit containing a lubricant.

2. Description of the Related Art

FIGS. 1 and 2 are respectively an illustration showing the entire configuration of a conventional image forming apparatus.

The image forming apparatus forms an image by charging uniformly an image forming area on an image bearing member by means of a charging unit, by writing the image on the image bearing member by means of an exposing unit, and using a toner frictionally charged on the image bearing member by means of a developing unit. Then, the image on the image bearing member is transferred onto a printing paper by means of a transfer unit directly onto the paper fed from a paper feeding unit or indirectly via an intermediate transfer member, after that the image is fixed onto the printing paper by means of a fixing unit.

Meanwhile, a residual untransferred toner remaining on the image bearing member is wiped off from the image bearing member by a cleaning unit. The image bearing member, being cylindrically-shaped or belt-shaped, has gone through a series of the image forming process steps and then enters into the next image forming process.

There are two systems of image forming apparatus involving such processes as described above. One is a revolver system in which a single image bearing member is present and an image is formed on the single image bearing member for every color. And the other is a tandem system in which an image bearing members is used for each color. The revolver system costs less. The tandem system costs high but allows for high-speed printing. At present, tandem system image forming apparatuses capable of printing at high speeds are mainly used.

When the tandem system is used, a formed image is primarily transferred onto an intermediate transfer member, all colors are superimposed on the intermediate transfer member, and then a full-color image with the all colors superimposed thereon is transferred to a printing paper by a secondary transfer unit.

The following is a description on the units used in each process of the conventional image forming apparatus.

<Charging Unit>

Examples of a charging unit (1) include a proximate charging system and contact charging system each using DC or DC overlapped with AC, and corona charging system. Examples of the corona charging system include corotron chargers and scorotron chargers.

As a charging unit charging an image bearing member, a corotron charger and a scorotron charger using a corona discharge have been mainly used so far. However, a charging unit (1) using a corona discharge has drawbacks that a large quantity of ozone is produced, and NOx, etc., produced by the corona discharge, adhere to the image bearing member which causes problems with an image deletion with time. Furthermore, to generate a corona discharge, a high voltage power source for applying a voltage of 5 kV to 10 kV was required. Therefore it is difficult to reduce the cost of the image forming apparatus.

To solve such a problem, in recent years, as a charging unit that can be applied to an image forming apparatus, there have been a variety of charging units proposed, such as a contact type charging unit that makes contact with an image bearing member without using a corona discharge, and a proximate type charging unit in which a charging unit is placed closely to an image bearing member. The contact type/proximate type charging units can solve above many drawbacks noted for a charging unit using corona discharge, however they cause such a problem that a wear amount of the image bearing member increases, which shortens the lifetime of the image bearing member. Furthermore, occurrence of noise is also a drawback when an alternating current is used for voltage applied. In addition, since a charging unit (1) rubs against an image bearing member with a toner or paper powder, the surface of the image bearing member is further contaminated and a drawback due to contamination of charging unit surface occurs.

<Exposing Unit>

Examples of an exposing unit (2) include such an exposing unit as using LD, LED lamps, and xenone lamps.

<Developing Unit>

Examples of a developing unit (3) include a one-component development unit (3) and a two-component development unit using a mixture of a toner and carrier.

Developers are classified into two types of a two-component developer composed of a toner and carrier and a one-component developer composed of a magnetic toner or non-magnetic toner. Generally, these toners are manufactured by a kneading pulverization method in which a resin, pigment, charge controlling agent, and releasing agent are cooled and then pulverized and classified. However, this method causes nonuniform particle diameters and nonuniform particle shapes of the toners and they are difficult to be controlled.

In such circumstance in recent years, there is a trend to intensionally control the particle diameter of a toner and solve the above-mentioned drawbacks. And as a granulation method in an aqueous system, toner polymerization methods such as an emulsification polymerization method and dissolution suspension method have become increasingly used.

In recent years, a high image quality is increasingly requested, especially in color image formation, in order for highly fine images to be put into practice, a toner having a reduced particle diameter and similar particle diameters are increasingly requested. When an image is formed using a toner with a widely dispersed distribution of particle diameter, it substantially causes drawbacks that a fine powder toner contaminates a developing sleeve, contact/proximate charging unit, cleaning blade, photoconductor, and carrier, and causes toner scattering, which make it difficult to satisfy both high image quality and high reliability. Meanwhile, when a toner with similar particle diameters and a sharp distribution of particle diameter is used, minute dot reproducibility is greatly improved because of its uniform developing behavior of individual toner particles.

However, when a toner with reduced particle diameters and similar particle diameters is used, problems with cleaning ability arise. In particular, in blade cleaning it is impossible to remove a toner having similar and reduced particle diameters stably. To solve the problem, various methods to improve cleaning ability are proposed by using an improved toner. Among these methods, a method is present in which a toner is deformed from a spherically shaped toner to improve the cleaning ability. This method enables to block flow of the toner much easily by a blade cleaning, through deforming the toner shape with concomitant decrease in flowability of a fine particle toner. Note, however, that when a toner is deformed to too much degree minute dot reproducibility degrades with unstable behaviors of the toner in developing step. In this way since properties of a toner such as transfer quality, transfer efficiency, and cleaning ability are influenced by toner shape, it is required to optimally design the distribution of toner shape in order to obtain a toner having above described properties.

<Transfer Unit>

Examples of a transfer unit (4) include transfer units using a transfer belt, transfer charger, and transfer roller.

<Cleaning Unit>

Examples of a cleaning unit (7) include a blade-shape cleaning blade composed of polyurethane rubber, silicone rubber, nitrile rubber, chloroprene rubber and so forth, or a fur brush, elastic roller, roller covered with a tube, nonwoven cloth, and so forth.

So far, a cleaning method using a blade was mainly used for cleaning in image forming apparatuses using electrophotography and there have been many image forming apparatuses having only cleaning units (7) of blades. In addition some high-speed machines are equipped with a cleaning support unit (11) in order to avoid a situation in which a large amount of the toner adhere partially.

In this case, when a cleaning blade is used in a cleaning unit, the cleaning blade has contact with the image bearing members in a trailing direction or in a counter direction.

<Cleaning Support Unit>

When usage of cleaning units alone results in insufficient removal of an untransferred residual toner remaining on an image bearing member, commonly a cleaning support unit is placed downstream with respect to the rotational direction of the image bearing member, upstream to a cleaning unit, thereby cleaning ability is improved.

Examples of a cleaning support unit include a fur brush, elastic roller, roller covered with a tube, and unwoven cloth.

Conventionally, a cleaning support unit is placed upstream to the cleaning unit, and examples thereof include above described members. The method aims to improve cleaning ability by disturbing mechanically a toner which enters a cleaning unit using a cleaning unit.

An image forming apparatus is also commercialized in which a voltage is applied to a cleaning support unit at this time and the cleaning ability is enhanced through control of polarity of the toner.

<Aqueous Granulation Toner>

In such image forming apparatuses as described above, an aqueous granulation toner is desired to be used in order to obtain images with high quality. Specifically, a technology to manufacture a spherical toner in a wet process by suspension polymerization or emulsification polymerization method (Japanese Patent Application Laid-Open (JP-A) No. 01-257857), and a technology to conglobate a pulverized toner by hearing (Japanese Patent Application Publication (JP-B) No. 04-27897 and Japanese Patent Application Laid-Open (JP-A) No. 06-317928) are proposed. According to these toner production methods, a toner is easily reduced in particle diameter.

<Lubricant Applying Unit>

Use of an aqueous granulation toner makes it difficult to maintain cleaning ability level. Consequently, when a highly spherical toner is used, an unit is often placed to coat the image bearing member with a lubricant to improve cleaning ability margin, or to prevent the wear of the image bearing member due to an electric discharge from the charging unit, the wear and filming of the image bearing member due to a contact with the cleaning unit or toner.

Examples of a lubricant applying unit may include units to coat the image bearing member by using a fur brush or loop brush, roller, and belt or units to coat directly the image bearing member with a solid lubricant or with a powder of a lubricant.

<Lubricant Applying Method>

As a method to coat an image bearing member with the lubricant as described above, a technology was used, in which a lubricant was externally added to a toner and the image bearing member was coated with the lubricant with a supply of the toner. However, this technology could not prevent the image bearing member from wear due to discharge and due to a contact with members, because areas on the image bearing member where no toner was supplied (a non-image area) were not coated with the lubricant.

In addition, another technology was also used, in which a solid lubricant was directly contacted with a cleaning support unit and an image bearing member was coated with the lubricant thereby. However, this technology could not prevent the image bearing member from wear due to discharge and to contact with members, because areas on the image bearing member where an untransferred residual toner was present (image area), were not coated with the lubricant.

To solve these problems, a method was proposed, in which an image bearing member was directly contacted with a powder lubricant downstream to the cleaning unit with respect to the rotational direction of the image bearing member, further a smoothing blade for the lubricant was placed downstream with respect to the rotational direction of the image bearing member and upstream to the charging unit, and the whole surface of the image bearing member was coated with the lubricant thereby. In addition, as a similar method which enables to coat uniformly with a lubricant, another method was also proposed, in which a lubricant applying unit was pressed with a lubricant downstream to the cleaning unit with respect to the rotational direction of the image bearing member, the image bearing member was coated with the lubricant by means of the lubricant applying units, further a smoothing blade for the lubricant was placed downstream with respect to the rotational direction of the image bearing member and upstream to the charging unit, and the whole surface of the image bearing member were coated with the lubricant thereby. By using these methods, it became possible to coat the whole surface of an image bearing member with a lubricant and to protect the whole surface of the image bearing member from wear due to the electric discharge from the charging unit or due to the contact with the members.

<Lubricant>

In order to extend the lifetime and to promote image quality, some examples to coat an image bearing member with a lubricant are known. The reason why a lubricant is supplied over a surface of an image bearing member is to solve the following two problems.

(i) to prevent a generation of toner filming (fusion)

(ii) to improve a transfer efficiency by lowering a friction coefficient and prevent an occurrence of cleaning defects To solve these problems disclosed methods (for example, JP-A Nos. 2002-244516, 2002-156877, 2002-55580, and 2002-244487) are known and the problems are solved by coating an image bearing member (8) with a lubricant (5). In all the cases of these examples, the problems are solved by coating an image bearing member (8) with a lubricant (5) and by lowering the friction coefficient.

Furthermore, JP-A No. 2002-229227 discloses an example, in which in order to extend the lifetime of a charging unit and image bearing member, a noncontact charging unit is used, an inorganic particle is dispersed in a photosensitive layer of the image bearing member, and the wear resistance is improved by coating with such a lubricant as zinc stearate.

In addition, another example of image forming apparatus is present, which has a blade-shape auxiliary member configured to attach a lubricant thinly and uniformly between the charging unit and the developing unit the image bearing member and to block lubricant particles having large diameters (refer to JP-A No. 10-142897).

Examples of lubricants used include fluorochemical resins in a powder form, solid form, and film form of (such as polytetrafluoroethylene, polyvinylidene-fluoride), metal fatty acid salt having a lamella crystal structure such as zinc stearate, magnesium stearate, and calcium stearate (the other examples include lauroyl lysine, sodium zinc salt of monocetyl phosphate ester, and calcium lauroyl taurine), liquid materials such as silicone oils and fluorochemical oils, natural waxes, and synthetic waxes, and gaseous materials. Each of these lubricants is externally added and reacted.

<Applied Amount of Lubricant>

As an applied amount of a lubricant over a surface of an image bearing member at that time, an optimal applied amount is proposed as follows (refer to JP-A No. 2005-17469).

An optimal amount of a lubricant is determined so that a percentage of the number of specific elements of the lubricant materials detected by an X-ray photoelectron spectrometer (XPS) to the sum of the number of all elements of materials constituting the outermost surface of the charged body detected by XPS is set to a value equal to or more than a value calculated by the following Expression (1).

$$1.52\times10^{-4}\times\{V_{pp}-2\times V_{th}\}\times f/v\times N_{\alpha} \qquad \text{Expression (1)}$$

(Wherein, "$V_{pp}$" is a peak-to-peak voltage value (V) of AC voltage, "f" is a frequency (Hz) of alternating current component applied to the charging unit (1), "v" is a moving speed (mm/sec) of the surface of the charged body, "$N_{\alpha}$" is the number of specific elements in a molecule of the lubricant material. And "$V_{th}$" is a sparkover voltage and calculated using the following Expression (2).

$$V_{th}=312+6.2\times(d/\epsilon_{opc}+G_p/\epsilon_{air})+(7737.6\times d/\epsilon_{opc})^{1/2} \qquad \text{Expression (2)}$$

(Wherein, "d" is a membrane thickness (μm) of the charged body, "$\epsilon_{opc}$" is a specific inductive capacity of the charged body, "$\epsilon_{air}$" is a specific inductive capacity of space between the charged body and the charging unit, "$G_p$" is the minimum distance (μm) between the surface of the charging unit (1) and the surface of the charged body.

By above described invention concerning applying method of a lubricant, the whole surface of an image bearing member could be coated uniformly with a lubricant, abrasion wear of the image bearing member due to an electric discharge from the charging unit could be reduced, and the lifetime of the image bearing member could be extended thereby.

However it was found that thin line reproducibility is remarkably degraded, when an aqueous granulation toner with its volume average particle diameter (Dv) being in the range of 3.0 μm<Dv<6.5 μm, containing at least a binder resin, colorant, and laminar inorganic mineral in which at least part of a metal cation is modified with an organic ion, is used for printing.

Usually when a thin line is output as an image, a toner layer is formed thick in the central part of the thin line, and when the image is transferred onto an intermediate transfer member or onto a printing paper, a transfer pressure could not be evenly applied to the toner layer, the transfer pressure is concentrated on the central part of the thin line where the toner layer is thick. Consequently, the toner layer is packed and flocculated strongly in the central part of the thin line where the transfer pressure is concentrated.

At this time, when an electrostatic or nonelectrostatic adhesion force to the object on which the toner image was formed before the transfer is high, the whole of the toner layer can not be transferred at the central part of the thin line where the toner layer strongly flocculates, which results in a transfer defect (missing the central part of thin line).

Furthermore, this phenomenon tends to take place in a situation when developer is stirred for long time in an environment of few replacements of a toner in a development container and the toner degrades with time. As a result flowability of the toner become poor. And above described poor transfer (missing the central part of thin line) is considered to tend to take place in above situations because of an increase in nonelectrostatic adhesion force of the toner and easy flocculation of the toner layer.

BRIEF SUMMARY OF THE INVENTION

The object of the present invention is to provide an image forming apparatus capable of producing high quality images stably with time without causing missing a central part of a thin line, while maintaining an appropriate flowability of the toner, even when a toner degrades with time and external additives therein are buried or detached, wherein the toner is a toner which contains at least, a binder resin, a colorant, and a laminar inorganic mineral in which at least part of an ion in layers is modified with an organic ion, the toner is granulated in an aqueous system, the volume average particle diameter Dv of the toner is in the range of 3.0 μm<Dv<6.5 μm.

MEANS FOR SOLVING THE PROBLEM

As a result of studies and investigations to solve the above mentioned problems, the present inventors found that the above problems can be solved by setting the aspect ratios of toner particles in the range of from 0.81 to 0.89 (including 0.81 and 0.89), in an aqueous granulation toner with its volume average particle diameter (Dv) being in the range of 3.0 μm<Dv<6.5 μm, containing at least a binder resin, colorant, and laminar inorganic mineral in which at least part of an ion is modified with an organic ion. These findings lead to the present invention.

The following is a detailed description of aspects of the present invention.

(1) A toner used in an image forming apparatus, containing at least, a binder resin, a colorant, and a laminar inorganic mineral in which at least part of an ion in layers is modified with an organic ion, wherein the toner is granulated in an aqueous system, the volume average particle diameter Dv of the toner is in the range of 3.0 μm<Dv<6.5 μm, the aspect ratio of the toner is 0.81 to 0.89, and the surface of the toner is externally added with a plurality of types of fine particles.

(2) The toner according to item 1, wherein the ion in the layers of the laminar inorganic mineral is a metal cation and the organic ion is an organic cation.

(3) The toner according to any one of items 1 and 2, wherein the ratio of the volume average particle diameter (Dv) to the number average particle diameter (Dv/Dn) is in the range of 1.00 to 1.40.

(4) The toner according to any one of items 1 to 3, wherein the content of a particle of 2 μm or less in diameter is 1% by number to 10% by number.

(5) An image forming apparatus, having at least, an image bearing member, a charging unit configured to charge the surface of the image bearing member, an exposing unit configured to imagewisely expose the surface of the image bearing member to write a latent image on the image bearing member, a developing unit configured to develop the latent image written on the image bearing member with a toner, a transfer unit configured to transfer the developed toner image onto an intermediate transfer member or to a printing paper, and a cleaning unit configured to remove an untransferred residual toner remaining on the image bearing member, wherein the toner used in development on the image bearing member by the developing unit is a toner according to any one of items 1 to 4.

(6) The image forming apparatus according to item 5, wherein a toner image is transferred at least twice during the period from the time when the latent image is developed on the surface of the image bearing member with toner to the time when the printing paper onto which the toner image is transferred is passed through a fixing unit.

(7) A process cartridge having a developing unit, and at least one unit selected from the group consisting of an image bearing member, a charging unit, and a cleaning unit, which are integrated into one unit, wherein the process cartridge is detachably mounted to a main body of an image forming apparatus, the toner used in development on the image bearing member by the developing unit is a toner according to any one of items 1 to 4.

Hereinafter, above described aspects 1 to 7 of the present invention is referred to as "the invention aspects 1 to 7".

EFFECT OF THE INVENTION (Invention Aspects 1 and 2)

By setting the shape of a toner base particle within the defined range, an appropriate flowability of the toner can be maintained with time while keeping appropriate fixing properties and charge properties of the toner, and the toner hardly flocculates, and the transfer quality is not impaired.

In addition, by adding a plurality of types of fine particles to the surface of the toner base particle, toner properties in the early stage can be kept appropriate, and in the early stage, further stable transfer quality can be obtained.

(Invention Aspect 3)

With this aspect, stability of developing property of the toner in a developing device can be improved, and further, uniformity of transfer of the toner layers at the time of transfer can be secured.

(Invention Aspect 4)

When toner particles with smaller diameters are contained in a large amount, a BET-specific surface area of the toner is enlarged by just that match, therefore, appropriate toner properties, for example, not only transfer quality but also developing property or cleaning ability cannot be obtained because a coverage of the toner surface is lowered even when the same additives are used. As a result, the definition according to this aspect is necessary. With this aspect, appropriate toner properties can be secured and stable high image quality can be obtained in an early stage and even with time.

(Invention Aspect 5)

By forming an image by means of an image forming apparatus using a toner according to any one of the invention aspects 1 to 4, stable high image quality can be obtained in an early stage and with time, and also when the toner degrades with time, marginal abilities as a system of the image forming apparatus can be improved such as in development, cleaning, and transfer.

(Invention Aspect 6)

Even with the same degradation state of a toner, as the number of transfer times is increased during the time in which an image is fixed and output on a printing paper, the image quality becomes degraded. However, according to this aspect, reproducibility of thin lines can be secured even when transfer is repeated at a plurality of times.

(Invention Aspect 7)

By mounting a developing unit, and at least one unit selected from the group consisting of an image bearing member, a charging unit, and a cleaning unit, which are integrated into one unit, displacement of each member due to vibration, etc of the apparatus can be prevented.

DETAILED DESCRIPTION OF THE INVENTION

The following is a description of the best mode for carrying out the invention; however the present invention is not limited thereto.

Figure 1:
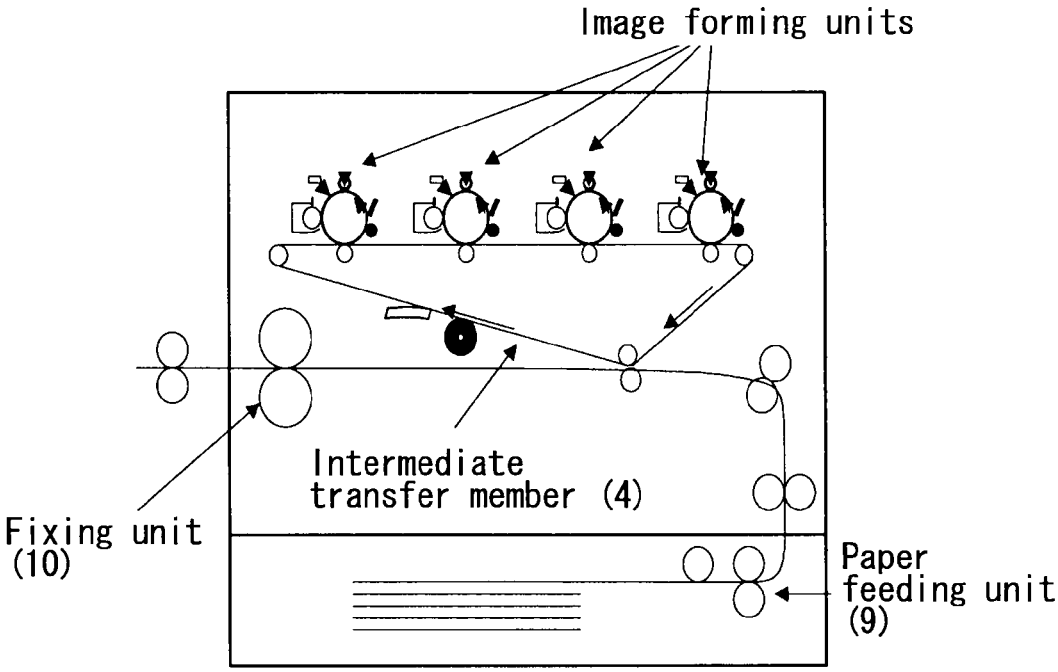
FIG. 1 is an illustration showing the entire structure of an image forming apparatus.
Figure 2:
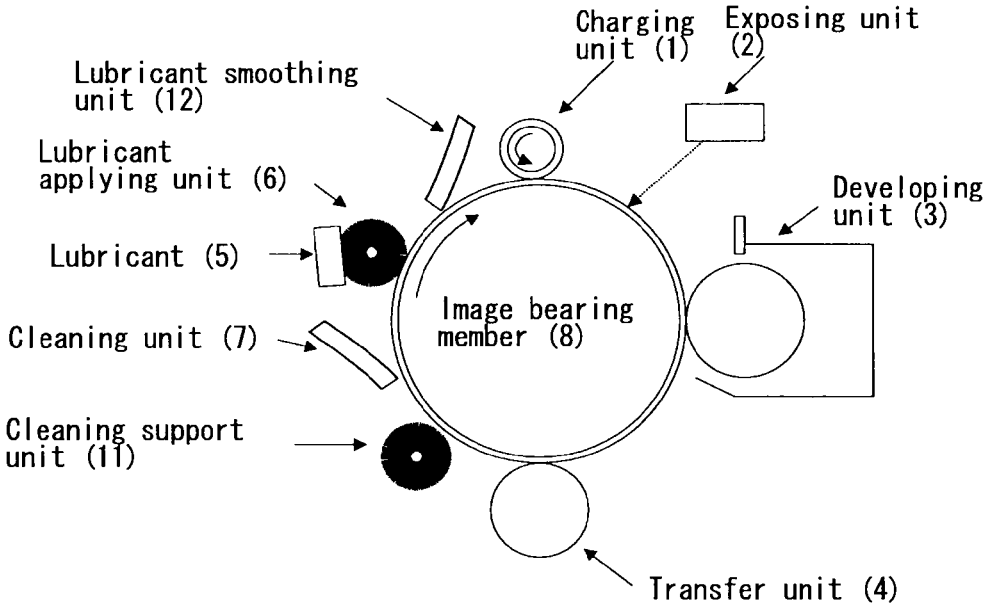
FIG. 2 is an illustration showing an image forming unit used in an image forming apparatus.

The present invention may be used in image forming apparatuses using electrophotography. First, the image forming apparatus will be described below referring to FIGS. 1 and 2.

The image forming apparatus forms an image by charging uniformly an image forming area on the surface of an image bearing member by means of a charging unit, by writing the image on the image bearing member by means of an exposing unit, and using a toner, frictionally charged, on the image bearing member by means of a developing unit. Then, an image on the image bearing member is transferred onto a printing paper by means of a transfer unit directly onto the printing paper fed from a paper feeding unit or indirectly via an intermediate transfer member, after that the image is fixed onto the printing paper by means of a fixing unit.

Meanwhile, a residual untransferred toner remaining on the image bearing member is wiped off from the image bearing member by means of a cleaning support unit and a cleaning unit, and the image bearing member is coated with a lubricant by means of a lubricant applying unit with the lubricant being coated with on the whole surface of the image bearing member by a smoothing unit for a lubricant. The image bearing member, being cylindrically-shaped or belt-shaped, has gone through a series of the image forming process steps and then enters into the next image forming process.

There are two systems of image forming apparatus involving such processes as described above. One is a revolver system in which a single image bearing member is present and an image is formed on the single image bearing member for every color. And the other is a tandem system in which an image bearing members is used for each color.

Here, examples of each unit include the following.

Examples of a charging unit include corona chargers, corotron chargers, scorotron chargers, contact charging systems, and noncontact charging systems.

Examples of an exposing unit (2) include such exposing methods as using LD, LED lamps, and xenone lamps.

Examples of a developing unit (3) include a one-component development unit (3) and two-component development unit (3) using a mixture of a toner and a carrier for development. Toners used in development units are the toners according to the present invention.

Examples of a transfer unit (4) include the transfer unit using a transfer belt, transfer charger, and transfer roller.

Examples of a cleaning support unit (11) include a fur brush, elastic roller, roller covered with a tube, and unwoven cloth. Sometimes a plurality of the cleaning support unit is mounted in the image forming apparatus. At this time a voltage may be applied to the cleaning support unit to control the polarity of a toner, and cleaning ability may be improved thereby. In addition a loop brush with tips of brush looped may be used. An auxiliary cleaning brush may not be equipped.

Examples of a cleaning unit (7) include a blade-shape cleaning blade composed of polyurethane rubber, silicone rubber, nitrile rubber, chloroprene rubber and so forth. Sometimes a plurality of the cleaning unit is mounted. At this time when the cleaning blade is contacted with the image bearing member in counter direction, a blade with an edge shape of obtuse angle (90° to 180°) may be used for the contact with the image bearing member. By using the cleaning blade with such a blade shape, a contacting pressure of the blade to the image bearing member may be increased and cleaning ability may be improved thereby.

Furthermore, a toner on the surface of the image bearing member may be removed electrostatically by applying a voltage to such a cleaning unit. And a cleaning blade may be contacted with the image bearing member in a trailing direction or in a counter direction with respect to the rotational direction of the image bearing member.

Examples of a lubricant applying unit (6) may include units to coat the image bearing member by a fur brush or loop brush, roller, and belt or units to coat directly the image bearing member with a solid lubricant or with a powder of a lubricant. In addition a loop brush with tips of the brush looped may be used.

Examples of a lubricant (5) include fluorochemical resins in a powder form, solid form, and film form of (such as polytetrafluoroethylene, polyvinylidene-fluoride), a metal fatty acid salt having a lamella crystal structure such as zinc stearate, magnesium stearate, and calcium stearate (the other examples include lauroyl lysine, sodium zinc salt of monocetyl phosphate ester, and calcium lauroyl taurine), liquid materials such as silicone oils and fluorochemical oils, natural waxes, and synthetic waxes, and gaseous materials. Each of these lubricants is externally added and reacted.

In addition when the lubricant (5) used is a metal salt of fatty acids, the image bearing member is desirably coated with the lubricant in the applied amount defined below.

The applied amount of the lubricant is determined so that a percentage of the number of specific elements of the lubricant materials detected by an X-ray photoelectron spectrometer (XPS) to the sum of the number of all elements of materials constituting the outermost surface of the charged body detected by XPS is set to a value equal to or more than a value calculated by the following Expression (1).

$$1.52\times10^{-4}\times\{V_{pp}-2\times V_{th}\}\times f/v\times N_{\alpha} \qquad \text{Expression (1)}$$

(Wherein, "$V_{pp}$" is a peak-to-peak voltage value (V) of AC voltage, "f" is a frequency (Hz) of an alternating current component applied to the charging unit (1), "v" is a moving speed (mm/sec) of the surface of the charged body, "$N_{\alpha}$" is the number of specific elements in a molecule of the lubricant material. And "$V_{th}$" is a sparkover voltage and calculated using the following Expression (2).

$$V_{th}=312+6.2\times(d/\epsilon_{opc}+G_p/\epsilon_{air})+(7737.6\times d/\epsilon_{opc})^{1/2} \qquad \text{Expression (2)}$$

(Wherein, "d" is a membrane thickness (Jim) of the charged body, "$\epsilon_{opc}$" is a specific inductive capacity of the charged body, "$\epsilon_{air}$" is a specific inductive capacity of the space between the charged body and the charging unit (1), "$G_p$" is the minimum distance (μm) between the surface of charging unit (1) and the surface of charged body.

Examples of a smoothing unit of a lubricant (12) include a blade-shape smoothing unit used for a lubricant composed of polyurethane rubber, silicone rubber, nitrile rubber, chloroprene rubber and so forth. At this time when the blade is contacted with the image bearing member in a counter direction, a blade with an edge shape of obtuse angle (90° to 180°) may be used for the contact with the image bearing member. By using a blade with such a blade shape, a contacting pressure of the blade to the image bearing member may be increased and smoothing efficiency of the lubricant may be improved thereby. Furthermore, a toner passed through the cleaning unit may be removed electrostatically from the surface of the image bearing member by applying a voltage to such a smoothing unit of a lubricant. And the smoothing blade used for a lubricant may be contacted with the image bearing member in a trailing direction or in a counter direction with respect to the rotational direction of the image bearing member.

<Particle Diameter Distribution>

For reproducing minute dots of 600 dpi or more, the volume average particle diameter of the toner is preferably 3 μm to 8 μm. A ratio of the volume average particle diameter (Dv) to the number average particle diameter (Dn) (Dv/Dn) is preferably in the range from 1.00 to 1.40. The closer (Dv/Dn) is to 1.00, the sharper the particle diameter distribution is. When using such a toner having small particle diameter and a narrow particle diameter distribution, a uniform charge distribution of the toner can be obtained, and high quality images with less background fog can be obtained, and, in electrostatic transfer method a high transfer rate can be obtained.

Furthermore, as particles with a size equal to 2 μm or less are contained in a large amount, a specific surface area per unit weight of the toner (a BET specific surface area) increases. Consequently, even when the same parts of additives are added, in a toner with a high content of particles of size equal to 2 μm or less, area actually coverable with external additives ([area covered by external additive]/[toner BET specific surface area] (%)) is reduced, a probability that a toner base particle directly makes contact with the toner increases, which results in poor toner flowability and in occurrence of missing the central part of thin line image. By controlling the proportion of the number of particles with size equal to 2 μm or less to 1% to 10%, the probability that a toner base particle directly makes contact with the toner may be reduced, appropriate toner flowability may be maintained, and occurrence of missing the central part of thin line may be prevented.

Furthermore, the fine particles of size equal to 2 μm or less are hardly developed, are deposited in film on the carrier surface, and prevent the carrier surface from contacting with other portions of the toner, which results in inability of newly supplied toner to be charged appropriately and easily cause problems with toner scattering and background smear.

Examples of measurement devices for a particle size distribution of a toner by a coulter counter method include COULTER COUNTER TA-II or COULTER MULTISIZER II (both manufactured by COULTER COMPANY LIMITED). The following is a description of the measurement method.

First, 0.1 ml to 5 ml of a surfactant agent (preferably alkylbenzene sulfonate) as a dispersing agent is added into 100 ml to 150 ml of an electrolyzed aqueous solution. As an electrolyzed solution preparation of about 1% NaCl aqueous solution using first-grade sodium chloride, such as ISOTON-II (manufactured by COULTER COMPANY LIMITED) may be used. Here, further 2 mg to 20 mg of a sample for the measurement is added. The electrolyzed solution suspended with the sample is subjected to a dispersing treatment for about one to three minutes by an ultrasonic distributor, the volume and number of the toner particles or the toner are measured by the measurement device using as an aperture of 100 μm, and the volume distribution and number distribution are calculated. The weight average particle diameter (D4) and the number average particle diameter may be calculated from the distributions thus obtained.

As channels, 13 channels are used, that is, channels of 2.00 μm to less than 2.52 μm; 2.52 μm to less than 3.17 μm; 3.17 μm to less than 4.00 μm; 4.00 μm to less than 5.04 μm; 5.04 μm to less than 6.35 μm; 6.35 μm to less than 8.00 μm; 8.00 μm to less than 10.08 μm; 10.08 μm to less than 12.70 μm; 12.70 μm to less than 16.00 μm; 16.00 μm to less than 20.20 μm; 20.20 μm to less than 25.40 μm; 25.40 μm to less than 32.00 μm; 32.00 μm to less than 40.30 μm; and thus particles of diameter of 2.00 μm to less than 40.30 μm are covered.

<Aspect Ratio>

For a measurement device of the aspect ratio, FPIA3000 is used.

First, 0.1 ml to 5 ml of a surfactant agent (preferably alkylbenzene sulfonate) as a dispersing agent is added into 100 ml to 150 ml of an electrolyzed aqueous solution. As an electrolyzed solution a preparation of about 1% NaCl aqueous solution using first-grade sodium chloride, such as ISOTON-II (manufactured by COULTER COMPANY LIMITED) may be used. Here, further 2 mg to 20 mg of a sample for the measurement is added. The electrolyzed solution suspended with the sample is subjected for about one to three minutes by an ultrasonic distributor, and the aspect ratio may be obtained by the measurement device.

Particles of diameters of 2.00 μm to less than 200.00 μm are covered for the measurement.

Figure 3:
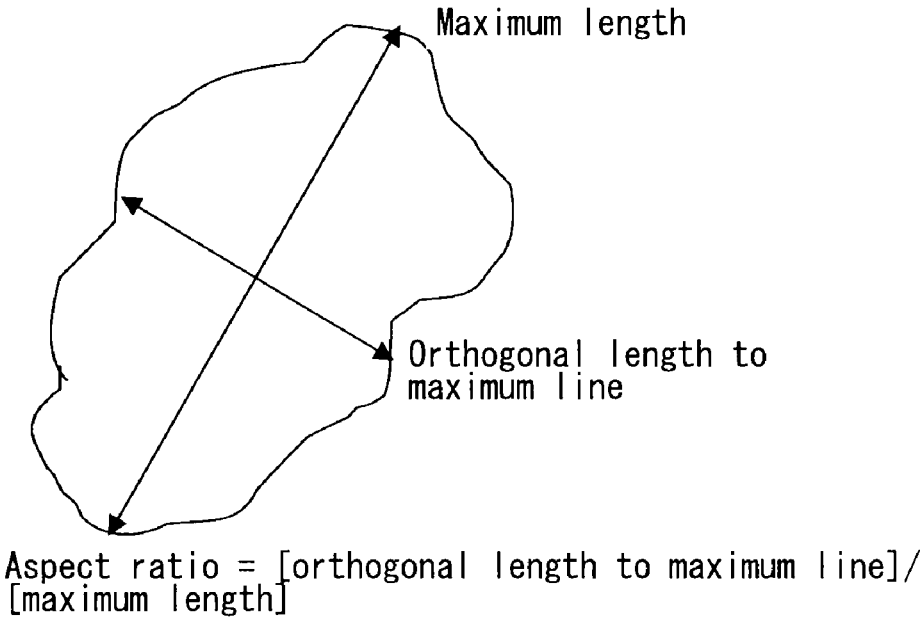
FIG. 3 is an illustration for the calculation method of aspect ratio of a toner.

The aspect ratio is obtained by the following equation as illustrated in FIG. 3.

Aspect ratio=[orthogonal length to maximum line]/[maximum length]

<Producing Method for Toner>

A toner according to the present invention may be produced by the following method.

It is effective for a toner to contain a laminar inorganic mineral in which at least part of an ion in the layers therein is modified with an organic ion (an organic modified clay). The organic modification (an ion modification/an ion substitution) with use of organic ions includes modifications using silicate compounds, such as clay, using organic cations and modifications of hydrotalcite compounds using organic anions.

Furthermore, this toner is preferably a toner, wherein a solution or fluid dispersion in an organic solvent of at least a binder resin, a prepolymer composed of a modified polyester resin, a compound elongated or cross-linked with the prepolymer, colorant, releasing agent, and laminar inorganic mineral in which at least part of a metal cation is modified with an organic cation (an organic modified clay), has a solid content of the laminar inorganic mineral in which at least part of a metal cation is modified with an organic cation (an organic modified clay) in dry solid of the solution or the fluid dispersion of 0.05% to 10%.

At this time, this toner is preferably a toner, wherein a solution or a fluid dispersion in an organic solvent of at least a binder resin, prepolymer composed of a modified polyester resin, compound elongated or cross-linked with the prepolymer, colorant, releasing agent, and laminar inorganic mineral (an organic modified clay) has a Casson yield value of 1 Pa to 100 Pa at 25° C., the solution or the fluid dispersion is subjected to a cross-linking reaction and/or elongation reaction in an aqueous medium, and the toner is obtained from the fluid dispersion thus obtained by evaporating the solvent.

The following is a further detailed description on the production method.

<Laminar Inorganic Mineral in which at Least Part of Metal Cation in Laminar Inorganic Mineral is Modified with Organic Cation>

A laminar inorganic mineral in which at least part of a metal cation is modified with an organic cation (an organic modified clay) used for the toner according to the present invention is preferably an organic modified clay, wherein a solution or a fluid dispersion in an organic solvent of at least a binder resin, prepolymer composed of a modified polyester resin, compound elongated or cross-linked with the prepolymer, colorant, releasing agent, and the organic modified clay has a Casson yield value of 1 Pa to 100 Pa at 25° C.

When the Casson yield value is less than 1 Pa, the target shape is hardly obtained, and when it is more than 100 Pa, productivity degrades.

In addition, the solid content of the organic modified clay in the dry solid of the solution or the fluid dispersion is preferably 0.05% by weight to 10% by weight. When the solid content is less than 0.05% by weight, the target Casson yield value can not be obtained, and when it is more than 10% by weight, fixing ability degrades.

Examples of the laminar inorganic mineral in which at least part of a metal cation therein is modified with an organic cation include an organic modified montmorillonite and organic modified smectite, and so forth.

<Measurement Method for Casson Yield Value>

The casson yield value can be measured by a high-shear viscometer, etc. The conditions for the measurement are as follows.

Device: AR2000 (manufactured by TA Instruments Inc.)

Shear stress: 120 Pa/5 min

Geometry: 40 mm steel plate

Geometry gap: 1 mm

Analysis software: TA DATA ANALYSIS (manufactured by TA Instruments Inc.)

A toner preferably used in the image forming apparatus of the present invention is a toner obtained by subjecting a toner material fluid in which at least a polyester prepolymer having functional groups containing nitrogen atoms, a polyester, a colorant, and a releasing agent in an organic solvent, to a cross-linking and/or elongation reaction in an aqueous solvent. The following is a description of the constituent materials and the production method of the toner.

<Polyester>

A polyester can be obtained by a polycondensation reaction between a polyvalent alcohol and a polyvalent carboxylic acid.

Examples of a polyvalent alcohol (PO) include divalent alcohols (DIO) and polyvalent alcohols with more than two valences (TO), and DIO singularly or mixtures of DIO and a small amount of TO is preferred. Examples of the divalent alcohols (DIO) include an alkylene glycol (such as ethylene glycol, 1,2-propylene glycol, 1,3-propylene glycol, 1,4-butanediol, and 1,6-hexanediol); an alkylene ether glycol (such as diethylene glycol, triethyleneglycol, dipropylene glycol, polyethyleneglycol, polypropylene glycol, and polytetramethylene ether glycol); an alicyclic diol (such as 1,4-cyclohexane dimethanol, and a hydrogenated bisphenol-A); bisphenol compounds (such as bisphenol-A, bisphenol-F, and bisphenol-S); an alkylene oxide (ethylene oxide, propylene oxide, and butylene oxide) adduct of an above alicyclic diol; alkylene oxide (ethylene oxide, propylene oxide, and butylene oxide) adducts of above bisphenol compounds.

Among these, preferably an alkylene glycol having 2 to 12 carbon atoms and alkylene oxide adducts of bisphenol compounds are used, more preferably an alkylene oxide adduct of bisphenol compound and a combination of the alkylene oxide adduct of bisphenol compound with an alkylene glycol having 2 to 12 carbon atoms are used. Examples of the trivalent or more alcohols (TO) include trivalent to octavalent or more polyvalent aliphatic alcohols (such as glycerin, trimethylolethane, trimethylolpropane, pentaerythritol, and sorbiol); trivalent or more phenols (trisphenol PA, phenolnovolac, and cresolnovolac); the above-mentioned alkylene oxide adducts of trivalent or more polyphenol compounds.

Examples of polyvalent carboxylic acids (PC) include divalent carboxylic acids (DIC) and trivalent or more polyvalent carboxylic acids (TC), and DIC singularly and mixtures of DIC and a small amount of TC are preferred. Examples of divalent carboxylic acids (DIC) include, an alkylenedicarboxylic acid (such as succinic acid, adipic acid, and sebacic acid); an alkenylenedicarboxylic acid (such as maleic acid and fumaric acid); an aromatic dicarboxylic acid (phthalic acid, isophthalic acid, terephthalic acid, and naphthalenedicarboxylic acid). Among these an alkenylenedicarboxylic acid having 4 to 20 carbon atoms and an aromatic dicarboxylic acid having 8 to 20 carbon atoms are preferable. Examples of trivalent or more polyvalent carboxylic acids (TC) include an aromatic polyvalent carboxylic acid having 9 to 20 carbon atoms (such as trimellitic acid and pyromellitic acid). In addition, as a polyvalent carboxylic acid (PC) an acid anhydride or a lower alkyl ester (methyl ester, ethyl ester, and isopropyl ester) of above PCs may be used and reacted with a polyvalent alcohol (PO).

A ratio of the polyvalent alcohol (PO) to the polyvalent carboxylic acid (PC) is, when expressed as an equivalent ratio of hydroxyl group [OH] to carboxyl group [COOH], i.e. [OH]/[COOH], usually 2/1 to 1/1, preferably 1.5/1 to 1/1, further preferably 1.3/1 to 1.02/1.

From a polycondensation reaction between the polyvalent alcohols (PO) and polyvalent carboxylic acids (PC), a polyester having hydroxyl groups is obtained by using a known esterified catalyst such as tetrabutoxy titanate and dibutyl tin oxide, by heating at 150° C. to 280° C., and then by distilling away produced water while reducing the pressure reduced as required. The hydroxyl group value of the polyester is preferably more than four, the acid value of a polyester is usually 1 to 30, is preferably 5 to 20. As the acid value increases, the polyester tends to be negatively charged, further to have excellent affinity of the toner with the printing paper at the time of fixing onto printing paper, and to have improved low temperature fixing ability.

However when the acid value is more than 30, stability of charge, especially stability against environmental fluctuation tends to degrade.

Furthermore, the weight average molecular weight of polyester is 10,000 to 400,000, preferably 20,000 to 200,000. When the polyester has a weight average molecular weight less than 10,000, offset resistance property degrades and thus the polyester is not preferable. And when polyester has a weight average molecular weight more than 400,000, low temperature fixing ability degrades and thus the polyester is not preferable.

The polyester preferably contains urea modified polyester, in addition to unmodified polyester obtained in above polycondensation reaction. A urea modified polyester can be obtained, by reacting a carboxyl group or a hydroxyl group, etc at the terminals of polyester obtained by above polycondensation reaction with a polyvalent isocyanate compound (PIC) to obtain a polyester prepolymer (A) having an isocyanate group, and reacting the obtained polyester prepolymer (A) with amines, thereby molecular chains are cross-linked and/or elongated.

Examples of polyvalent isocyanate compounds (PIC) include aliphatic polyvalent isocyanates (such as tetramethylenediisocyanate, hexamethylenediisocyanate, and 2,6-diisocyanatomethylcaproate); alicyclic polyisocyanates (such as isophoronedilsocyanate and cyclohexylmethanediisocyanate); aromatic diisocyanates (such as tolylenedilsocyanate and diphenylmethanediisocyanate); aromataliphatic diisocyanates (such as $\alpha,\alpha,\alpha'$, $\alpha'$-tetramethylxylylenediisocyanate); isocyanate compounds; above polyisocyanate blocked by phenol derivatives, oximes, and caprolactums, etc; and combinations of two or more thereof.

For a ratio of the polyvalent isocyanate compound (PIC), when expressed as equivalent ratio of isocyanate group [NCO] to hydroxyl group [OH] of polyester with hydroxyl group, i.e. [NCO]/[OH], the ratio is usually 5/1 to 1/1, preferably 4/1 to 1.2/1, further preferably 2.5/1 to 1.5/1. When the ratio [NCO]/[OH] is more than 5, low temperature fixing ability degrades. When the molar ratio of [NCO] is less than one and when urea modified polyester is used, hot offset resistance property degrades with urea content in the ester reduced.

The content of the polyvalent isocyanate compound (PIC) constituents in polyester prepolymer (A) having isocyanate groups is usually 0.5% by weight to 40% by weight, preferably 1% by weight to 30% by weight, further preferably 2% by weight to 20% by weight. When the content is less than 0.5% by weight, hot offset resistance property degrades and it is disadvantageous in that both heat-resistance/storage stability and low temperature fixing ability are satisfied. Furthermore, when the content is more than 40% by weight, low temperature fixing ability degrades.

The number of isocyanate groups contained per molecule of polyesterprepolymer (A) having isocyanate groups, is usually one or more, preferably on average 1.5 to 3, further preferably on average 1.8 to 2.5. When the number is less than one per molecule, hot offset resistance property degrades due to lowered molecular weight of the urea modified polyester.

Next, examples of amines (B) reacted with the polyesterprepolymer (A) include divalent amine compounds (B1), trivalent or more polyvalent amines (B2), aminoalcohols (B3), aminomercaptans (B4), amino acids (B5), and any one of B1 to B5 of amino group blocked compounds (B6).

Examples of the divalent amine (B1) include, aromatic diamine (such as phenylenediamine, diethyltoluenediamine, and 4,4'-diaminodiphenylmethane); alicyclic diamine (such as 4,4'-diamino-3,3'-dimethyldicyclohexylmethane, diaminecyclohexane, and isophoronediamine); and aliphatic diamine (ethylenediamine, tetramethylenediamine, and hexamethylenediamine). Examples of trivalent or more polyvalent amines (B2) include diethylenetriamine and triethylenetetramine. Examples of aminoalcohols (B3) include ethanolamine and hydroxyethylaniline. Examples of aminomercaptans (B4) include aminoethylmercaptan and aminopropylmercaptan. Examples of amino acids (B5) include aminopropionic acid and aminocaproic acid. Examples of any one of B1 to B5 of amino group blocked compounds (B6) include ketimine compounds obtained from the amine compounds of B1 to B5 and ketone compounds (such as acetone, methylethylketone, and methylisobutylketone) and oxazolidine compounds. Among these amine compounds (B), B1 and mixtures of B1 and a small amount of B2 are preferred.

A ratio of amine (B) is, when expressed as equivalent ratio of isocyanate group [NCO] in polyesterprepolymer (A) having isocyanate group to amino group [NHx] in the amines, i.e. [NCO]/[NHx], usually 2/1 to 1/2, preferably 1.5/1 to 1/1.5, further preferably 1.2/1 to 1/1.2. When [NCO]/[NHx] is more than 2 or less than ½, hot offset resistance property degrades due to lowered molecular weight of the urea modified polyester.

Furthermore, the urea modified polyester may contain a urethane bond in addition to a urea bond. The molar ratio of the urea bond content to the urethane bond content is usually 100/0 to 10/90, preferably 80/20 to 20/80, further preferably 60/40 to 30/70. When the molar ratio of urea bond is less than 10%, hot offset resistance property degrades.

The urea modified polyester is produced by such method as the one-shot method. A polyvalent alcohol (PO) and a polyvalent carboxylic acid (PC) are heated at 150° C. to 280° C. in the presence of a known esterified catalyst such as tetrabutoxy titanate and dibutyl tin oxide, and a polyester having a hydroxyl group is obtained by distilling away produced water while reducing the pressure as required. Then polyesterprepolymer (A) having an isocyanate group is obtained by reacting the polyester having hydroxyl groups with a polyvalent isocyanate (PIC) at 40° C. to 140° C. Further urea modified polyester is obtained by reacting (A) with amines (B) at 0° C. to 140° C.

When the polyester having a hydroxyl group is reacted with (PIC) and when (A) is reacted with (B), solvents also may be used as required. Examples of employable solvents include solvents inactive against isocyanate (PIC), such as aromatic solvents (such as toluene and xylene); ketones (acetone, methylethylketone, and methylisobutylketone); esters (such as ethyl acetate); amides (such as dimethlyformamide and dimethylacetamide); and ether compounds (such as tetrahydrofuran).

Furthermore, the molecular weight of the urea modified polyester thus obtained may be adjusted by using a reaction stopper as required in a cross-linking and/or an elongation reaction of polyesterprepolymer (A) and amines (B). Examples of the reaction stopper include monoamines (such as diethylamine, dibutylamine, butylamine, and laurylamine) and blocked monoamines (ketimine compounds).

The weight average molecular weight of the urea modified polyester is usually 10,000 or more, preferably 20,000 to 10,000,000, further preferably 30,000 to 1,000,000. When the weight average molecular weight is less than 10,000, hot offset resistance property degrades. When the urea modified polyester is used in addition to the above described unmodified polyester, the number average molecular weight of the urea modified polyester is not particularly limited, and may be a number average molecular weight with which the above described weight average molecular weight can be easily obtained. When the urea modified polyester is used singularly, the number average molecular weight is usually 2,000 to 15,000, preferably 2,000 to 10,000, further preferably 2,000 to 8,000. When the number average molecular weight is more than 20,000, glossiness when used in a full-color apparatus and low temperature fixing ability degrade.

Use of the urea modified polyesters in combination with the unmodified polyester is preferred to a single use of the urea modified polyester, since in the former case, the low temperature fixing ability and glossiness when used in the full-color image forming apparatus 100 are improved. In addition, the unmodified polyester may contain a polyester modified by chemical bonds other than a urea bond. In order to have a good low temperature fixing ability and hot offset resistance property, it is preferable that the unmodified polyester and the urea modified polyester are at least partly compatible. Therefore, it is preferable that the urea modified polyester has a composition similar to that of the unmodified polyester.

Furthermore, the weight ratio of the unmodified polyester to the urea modified polyester is usually 20/80 to 95/5, preferably 70/30 to 95/5, further preferably 75/25 to 95/5, and particularly preferably 80/20 to 93/7. When the weight ratio of the urea modified polyester to the unmodified polyester is less than 5%, both of heat-resistance/storage stability and low temperature fixing ability are not satisfied, while hot offset resistance property degrades.

The glass transition temperatures (Tg) of the binder resin containing the unmodified polyester and the urea modified polyester is usually 45° C. to 65° C., preferably 45° C. to 60° C. When the glass transition temperature of the binder resin is less than 45° C., heat resistance of the toner degrades, and when the glass transition temperature of the binder resin is more than 65° C., the low temperature fixing ability becomes insufficient.

Furthermore, since the urea modified polyester easily resides on the surface of the toner base particle thus obtained, it tends to have a favorable heat-resistance/storage stability even when their glass transition temperature is low as compared to known toners using polyester.

<Colorant>

For colorants, all the known dyes and pigments can be used.

Examples of the colorants include carbon black, a nigrosine dye, iron black, naphthol yellow S, Hansa yellow (10G, 5G, and G), cadmium yellow, yellow iron oxide, loess, chrome yellow, titan yellow, polyazoyellow, oil yellow, Hansa yellow (GR, A, RN, and R), pigment yellow L, benzidine yellow (G and GR), permanent yellow (NCG), Balkan fast yellow (5G and R), tartrazine lake, quinoline yellow lake, Anthrazan yellow BGL, iso-indolinone yellow, red ocher, red lead, lead vermilion, cadmium red, cadmium mercury red, antimony rermilion, permanent red 4R, Para red, fire red, p-chloro-o-nitroaniline red, re-sole fast scarlet G, brilliant fast scarlet, brilliant carmine BS, permanent red (F2R, F4R, FRL, FRLL, and F4RH), fast scarlet VD, bell can fast robin B, brilliant scarlet G, re-sole rubin GX, permanent red F5R, brilliant carmine 6B, pigment scarlet 3B, Bordeaux 5B, toluidine maroon, permanent Bordeaux F2K, Herio Bordeaux BL, Bordeaux 10B, Bonn maroon light, Bonn maroon medium, eosine lake, rhodamine lake B, rhodamine lake Y, alizarin lake, thioindigo red B, thioindigo maroon, oil red, quinacridon red, pyrazolone red, polyazored, chromium vermilion, benzidine orange, Peri non orange, oil orange, cobalt blue, cerulean blue, alkali blue lake, peacock blue lake, Victoria blue lake, metal-free phthalocyanine blue, phthalocyanine blue, fast sky blue, indanthrene blue (RS and BC), indigo, permanent blue, Berlin blue, anthraquinone blue, fast violet B, methyl violet lake, cobalt purple, manganese purple, dioxazine violet, anthraquinone violet, chrome green, zinc green, chromium oxide, pyridian, emerald green, pigment green B, naphthol green B, green gold, acid green lake, Malachite green lake, phthalocyanine green, anthraquinone green, titania, zinc oxide, lithophone, and mixtures thereof. Contents of colorants in the toners are usually 1% by weight to 15% by weight, preferably 3% by weight to 10% by weight.

The colorant may be used as a masterbatch compounded with a resin. Examples of the binder resin to be used in a production of a masterbatch or to be kneaded with the masterbatch include polymers of styrene and substituted styrene, such as polystyrene, poly-p-chlorostyrene, and polyvinyltoluene, or copolymers of styrene or substituted styrene and vinyl compounds, polymethylmethacrylate, polybutylmethacrylate, polyvinyl chloride, polyvinyl acetate, polyethylene, polypropylene, polyester, epoxy resin, epoxypolyol resin, polyurethane, polyamide, polyvinyl butyral, polyacrylic resin, rosin, a modified rosin, terpene resin, an aliphatic or alicyclic hydrocarbon resin, an aromatic petroleum resin, chlorinated paraffin, paraffin wax, and these may be used singularly or as mixtures.

<Charge Controlling Agent>

For charge controlling agents, known agents may be used, including a nigrosine dye, triphenylmethane dye, chromium-containing metal complex dye, molybdic acid chelate pigment, rhodamine dye, alkoxyamine, a quaternary ammonium salt (including quaternary fluorine-modified ammonium salts), alkylamide, phosphorus or a phosphorus compound, tungsten or a tungsten compound, fluorine type activator, a metal salt of salicylic acid and a metal salt of a salicylic acid derivative, and so forth. Specifically they are BONTRON 03 of a nigrosine dye, BONTRON P-51 of a quaternary ammonium salt, BONTRON S-34 of a metal-containing azo dye, E-82 of an oxy-naphthoic acid metal complex, E-84 of a salicylic acid metal complex, E-89 of a phenolic condensate (the above is manufactured by Orient Chemical Industries, Ltd.), TP-302 of a quaternary ammonium salt molybdenum complex, TP-415 (the above is manufactured by Hodogaya Chemical, Inc.), COPY CHARGE PSY VP2038 of a quaternary ammonium salt, COPY BLUE PR of a triphenylmethane derivative, COPY CHARGE NEG VP2036 of a quaternary ammonium salt, COPY CHARGE NX VP434 (the above is manufactured by Hoechst AG), LRA-901, LR-147 of a boron complex (the above is manufactured by Japan Carlit Co., Ltd.), copper phthalocyanine, perylene, quinacrydon, azo pigment, and macromolecule compounds having a functional group such as sulfonate, carboxyl, and a quaternary ammonium salt and so forth. Among these charge controlling agents, especially the agents are preferably used that give a toner a negative polarity.

The amount of charge controlling agent used is determined depending on the type of binder resin, the presence or absence of additives used as required, and the production method of the toner including the dispersing method and cannot be unequivocally defined. It is preferably 0.1 to 10 parts by weight to 100 parts by weight of the binder resin, more preferably 0.2 to 5 parts by weight. When the amount of the charge controlling agent is more than 10 parts by weight, the charge ability of the toner is excessively high, the effect of the charge controlling agent is reduced, which leads to a degradation in flowability of the developer and a degradation in image density due to an increased electrostatic attraction force to developing roller.

<Releasing Agent>

A low melting wax with a melting point of 50° C. to 120° C. works in the dispersion with binder resins more effectively as a releasing agent at the interface between the fixing roller and the toner, which effectively reduce the hot offset phenomenon without applying such a releasing agent like an oil to the fixing roller. Examples of such a wax component include the following. Examples of waxes include plant waxes such as carnauba wax, cotton wax, Japan wax, rice wax and so forth, animal waxes such as beeswax, lanolin, and so forth, mineral waxes such as ozokerite, sercin, and so forth, and petroleum waxes such as paraffin, microcrystalline, petrolatum, and so forth. In addition to these natural waxes, examples of the waxes include synthetic hydrocarbon waxes such as Fischer-Tropsch wax, polyethylene wax, and so forth, and synthetic waxes such as esters, ketones, ethers, and so forth. Further, 12-hydroxystearic acid amide, stearic acid amide, phthalic imide anhydride, a fatty acid amide of chlorinated hydrocarbon, etc, and a crystalline macromolecule having a long alkyl group as side chains thereof such as homopolymers of polyacrylate (for example, a low molecular weight crystalline macromolecule resin such as poly-n-stearylmethacrylate, poly-n-laurylmethacrylate) and copolymers of polyacrylate (for example, a copolymer of n-stearylacrylate-ethylmethacrylate, etc.), and so forth may be used.

The charge controlling agent and the releasing agent may be melt-kneaded with the masterbatch and the binder resin, and may be added when toner materials are dissolved and dispersed in an organic solvent.

<Production Method of Toner>

The following is a description of the production method of the toner. Here, a preferable production method is described, however, the production method of the toner is not limited thereto.

1) A colorant, an unmodified polyester, a polyesterprepolymer having an isocyanate group, and a releasing agent are dispersed in an organic solvent to obtain a toner material fluid.

The organic solvent is preferably volatile with a boiling point less than 100° C. from the standpoint of easy removal after the formation of a toner base particle. Specific examples of such an organic solvent include, toluene, xylene, benzene, carbon tetrachloride, methlylene chloride, 1,2-dichloroethane, 1,1,2-trichloroethane, trichloroethylene, chloroform, monochlorobenzene, dichloroethylidene, methyl acetate, ethyl acetate, methyl ethyl ketone, methyl isobutyl ketone, used singularly or in combinations of two or more. Usage of aromatic solvents such as toluene and xylene, and halogenated hydrocarbons such as methylene chloride, 1,2-dichloroethane, chloroform, and carbon tetrachloride are particularly preferable. The amounts of the organic solvents used is usually 0 parts by weight to 300 parts by weight, preferably 0 parts by weight to 100 parts by weight, further preferably 25 parts by weight to 70 parts by weight to 100 parts by weight polyesterprepolymer.

2) The toner material fluid is emulsified in an aqueous medium in the presence of a surfactant and a resin fine particle.

The aqueous medium may be water alone or water containing such an organic solvent as alcohol (for example, methanol, isopropyl alcohol, and ethylene glycol), dimethylformamide, tetrahydrofuran, celsolve compounds (for example, methylcelsolve), lower ketone compounds (for example, acetone and methyl ethyl ketone).

The amount of the aqueous medium used is usually 50 parts by weight to 2,000 parts by weight, preferably 100 parts by weight to 1,000 parts by weight to 100 parts by weight toner material fluid. When the amount is less than 50 parts by weight, the dispersion state of the toner material fluid is insufficient and a toner having a predetermined particle diameter can not be obtained. When the amount is more than 20,000 parts by weight, it is not economical.

Furthermore, to obtain an excellent dispersed state of the toner material fluid in the aqueous medium, such dispersing agents as surfactants and resin fine particles are added suitably.

Examples of the surfactant include anionic surfactants such as alkylbenzene sulfonate, α-olefin sulfonate, and phosphate ester, cationic surfactants such as an amine salt type (for example, alkylamine salt, aminoalcohol fatty acid derivative, polyamine fatty acid derivative, and imidazoline) and a quaternary ammonium salt surfactant (for example, alkyltrimethyl ammonium salt, dialkyldimethyl ammonium salt, alkyldimethylbenzyl ammonium salt, pyridinium salt, alkylisoquinolinium salt, benzethonium chloride), nonionic surfactants such as fatty acid amide derivative and polyalcohol derivative, and ampholytic surfactants such as alanine, dodecyldi(aminoethyl)glycine, di(octylamioethyl)glycine, and N-alkyl-N,N-dimethyl ammonium betaine.

Alternatively, with use of surfactants with fluoroalkyl group, even in a very small amounts, the effect of the use can be improved.

Examples of anionic surfactants having a fluoroalkyl group which is preferably used include fluoroalkylcarboxylic acid having 2 to 10 carbon atoms and a metal salt thereof, disodium perfluorooctanesulfonylglutamate, sodium 3-[ω-fluoro(C6-C11)alkyloxy]-1-(C3-C4)alkyl sulfonate, sodium 3-[ω-fluoro(C6-C8)alkanoyl-N-ethylamino]-1-propanesulfonate, fluoro(C11-C20)alkylcarboxylic acid and a metal salt thereof, perfluoro(C7-C13)alkylcarboxylic acid and a metal salt thereof, perfluoro(C4-C12)alkylsulfonic acid and a metal salt thereof, perfluorooctanesulfonic acid diethanol amide, N-propyl-N-(2-hydroxyethyl) perfluorooctanesulfonamide, a perfluoro(C6-C10)alkylsulfonamidepropyltrimethylammonium salt, a perfluoro(C6-C10)alkyl-N-ethylsulfonylglycine salt, monoperfluoro(C6-C16)alkylethylphosphate ester, and so forth.

Examples of trade names of these surfactants include SURFLON S-111, S-112, and S-113 (manufactured by Asahi Glass Co., Ltd.), FRORARD FC-93, FC-95, FC-98, and FC-129 (manufactured by Sumitomo 3M Ltd.), UNIDYNE DS-101 and DS-102 (manufactured by DAIKIN INDUSTRIES, Ltd.), MEGAFAC F-110, F-120, F-113, F-191, F-812, F-833 (manufactured by DAINIPPON INK AND CHEMICALS, Inc.), FTOP EF-102, 103, 104, 105, 112, 123A, 123B, 306A, 501, 201, and 204 (manufactured by JEMCO Inc.), and FUTERGENT F-100 and F150 (manufactured by NEOS Co., Ltd.).

Furthermore, examples of cationic surfactants include aliphatic primary amine acid, aliphatic secondary amine acid or aliphatic tertiary amine acid which has a fluoroalkyl group, an aliphatic quaternary ammonium salt such as a perfluoro(C6-C10)alkylsulfonamidepropyltrimethyl ammonium salt, a benzalkonium salt, benzethonium chloride, a pyridinium salt, and an imidazolinium salt, and examples of their trade names include SURFLON S-121 (manufactured by Asahi Glass Co., Ltd.), FRORARD FC-135 (manufactured by Sumitomo 3M Ltd.), UNIDYNE DS-202 (manufactured by DAIKIN INDUSTRIES, Ltd.), MEGAFAC F-150 and F-824 (manufactured by DAINIPPON INK AND CHEMICALS, Inc.), FTOP EF-132 (manufactured by JEMCO Inc.), and FUTERGENT F-300 (manufactured by NEOS Co., Ltd.), and so forth.

A resin fine particle is added to stabilize the toner base particle formed in the aqueous medium. For this purpose, the resin fine particle is preferably added so that the coverage over the surface of the toner base particle is in the range of 10% to 90%. Examples of the resin fine particle include polymethlymethacrylate fine particles of 1 μm and 3 μm in diameter, polystyrene fine particles of 0.5 μm and 2 μm in diameter, and poly(styrene-acrylonitrile) fine particles of a 1 μm size, and examples of their trade names include PB-200H (manufactured by Kao Corp.), SGP (manufactured by SOKEN K.K.), TECHPOLYMER SB (manufactured by SEKISUI PLASTICS CO., LTD), SGP-3G (manufactured by SOKEN K.K.), MICROPEARL (manufactured by Sekisui Chemical Co., Ltd), and so forth.

In addition, an inorganic compound dispersing agent such as tricalcium phosphate, calcium carbonate, titanium oxide, colloidal silica, hydroxyapatite, and so forth may be used.

Dispersion liquid droplets may be stabilized by using a protective macromolecule colloid as a dispersing agent available in combination with the resin fine particle and the inorganic compound dispersing agent. Examples of the dispersing agent available in combination with the resin fine particle and the inorganic compound dispersing agent include acid compounds such as acrylic acid, methacrylic acid, α-cyanoacrylic acid, α-cyanomethacrylic acid, itaconic acid, crotonic acid, fumaric acid, and maleic acid or maleic acid anhydride; (meth)acrylic series monomer containing a hydroxyl group such as β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycol monoacrylic acid ester, diethyleneglycol monomethacrylic acid ester, glycerin monoacrylic acid ester, glycerin monomethacrylic acid ester, N-methylolacrylamide, and N-methylolmethacrylamide; vinyl alcohols or ether compounds of vinyl alcohol such as vinyl methyl ether, vinyl ethyl ether, and vinyl propyl ether; esters composed of vinyl alcohol and compounds having a carboxyl group, such as vinyl acetate, vinyl propionate, and vinyl butyrate; acrylamide, methacrylamide, and diacetoneacrylamide or a methylol compound of acrylamide, methacrylamide, and diacetoneacrylamide; acid chlorides such as acrylic acid chloride and methacrylic acid chloride; nitrogen-containing compound such as vinylpyridine, vinylpyrrolidone, vinylimidazole, and ethyleneimine, or homopolymers or copolymers of monomers with heterocyclic rings of the nitrogen-containing compound, and so forth; polyoxyethylene series such as polyoxyethylene, polyoxypropylene, polyoxyethylenealkylamine, polyoxypropylenealkylamine, polyoxyethylenealkylamide, polyoxypropylenealkylamide, polyoxyethylenenonyl phenyl ether, polyoxyethylenelauryl phenyl ether, polyoxyethylenestearyl phenyl ester, and polyoxyethylenenonyl phenyl ester; and celluloses such as methylcellulose, hydroxyethylcellulose, and hydroxypropylcellulose.

The dispersion method is not particularly limited, however, known devices based on a low-speed shear method, a high-speed shear method, a friction method, a high-pressure jet method, and an ultrasonic method, etc can be used. Among these devices, a device based on a high-speed shear method is preferable to provide a dispersion particle of diameter from 2 μm to 20 μm. When such a high-speed shear dispersing device is used, the number of revolutions per minute is not particularly limited, however, it is usually 1,000 rpm to 30,000 rpm, preferably 5,000 rpm to 20,000 rpm. The dispersion time is not particularly limited, however, it is usually 0.1 minutes to 5 minutes in the case of using batch method. The temperature at the time of dispersing is usually 0° C. to 150° C. (under pressure), is preferably 40° C. to 98° C.

The amines (B) are added and reacted with polyesterprepolymer (A) having an isocyanate group at the same time as preparation of the emulsified liquid of the toner material fluid. This reaction involves a cross-linking reaction and/or an elongation reaction of the molecular chains. The reaction time is selected depending on the reactivity of the isocyanate group structure of the polyesterprepolymer (A) to the amines (B), and it is usually 10 minutes to 40 hours, and preferably 2 hours to 24 hours. The reaction temperature is usually 0° C. to 150° C., preferably 40° C. to 98° C. In addition, a known catalyst may be used as required. Specifically, dibutyl tin laurate and dioctyl tin laurate are exemplified.

4) After the completion of the reaction, the organic solvent is removed from the emulsified dispersion (the reaction product), and the resultant particle is washed and dried to obtain a toner base particle.

A spindle-shaped toner base particle may be prepared by raising the temperature of the total system gradually while stirring in a laminar form, by stirring strongly at the defined temperature region, and then by removing the organic solvent. When a substance soluble in acids and alkalis such as a calcium phosphate salt is used as a dispersion stabilizer, the calcium phosphate salt is removed from the toner base particle by dissolving the calcium phosphate salt using an acid such as hydrochloric acid, and then washing in water. In addition to this method, the calcium phosphate salt may be removed by a decomposition effect by enzymes.

5) The toner is obtained by mixing a charge controlling agent with the toner base particle obtained above, and then externally adding an inorganic fine particle such as silica fine particle and a fine particle of titanium oxide. Specific examples of the inorganic fine particles include silica, alumina, titanium oxide, barium titanate, magnesium titanate, calcium titanate, strontium titanate, zinc oxide, tin oxide, silica sand, clay, mica, wollastonite, diatom earth, chromium oxide, cerium oxide, colcothar, antimony trioxide, magnesium oxide, zirconium oxide, barium sulfate, barium carbonate, calcium carbonate, silicon carbide, and silicon nitride.

In addition to these inorganic fine particles, a polymer fine particle can be used. Examples of the polymer fine particle include polystyrene and methacrylic acid esters obtained by a soap-free emulsification polymerization, suspension polymerization, and distributed polymerization, copolymers of acrylic acid esters, polycondensation series such as silicone, benzoguanamine, and nylon, and polymer particles from thermohardening resins.

The hydrophobicity of the external additives can be improved by subjecting them to a surface treatment to thereby prevent degradation of flowability and charging property of the toner even under a high humidity environment. Examples of preferable surface treatment agents include silane coupling agents, silylation agents, silane coupling agents having an alkyl fluoride group, organic titanate coupling agents, aluminum coupling agents, silicone oils, modified silicone oils. Particularly a hydrophobic silica and a hydrophobic titanium oxide obtained by subjecting the surfaces of silica and titanium oxide to a surface treatment agent are preferably used.

The above mentioned effects can be further improved by using a combination of a plurality of fine particles. "Externally adding a combination of a plurality of types of fine particles to the surface of the toner" means to externally add to the toner a combination of different types of fine particles with respect to any one of type of material (type of inorganic material: silica, titanium oxide, and alumina), average particle diameter, BET specific surface area, type of a hydrophobizing treatment agent, degree of hydrophobicity, shape, and water content.

Mixing of the charge controlling agent and external addition of the inorganic fine particle are carried out according to a known method using a mixer, etc.

With the treatments, a toner having a reduced particle diameter and a sharp particle diameter distribution can be easily obtained. In addition, by stirring the charge controlling agent and inorganic fine particle strongly in the step of removing the organic solvent, the shape of the toner can be controlled so as to have a shape between a sphere-shape to a rugby-ball shape and the surface morphology of the toner can be controlled between a smooth surface and a wrinkled surface.

<Method for Measuring Particle Diameter of 2 μm or Less>

Rate of occurrence of particles with diameter of 2 μm or less and degree of sphericity of the toner of the present invention may be determined by flow type particle image analysis equipment FPIA-2000 (manufactured by SYSMEX Corp.). Specifically the measurement is conducted by adding 0.1 ml to 0.5 ml of a surfactant as a dispersing agent, preferably an alkylbenzene sulfonate, to 100 ml to 150 ml of water from which solid impurities are removed in advance, in a container, and further about 0.1 g to 0.5 g of the sample for measurement is added. A suspension in which the sample is dispersed is subjected to a dispersion treatment for about 1 minute to 3 minutes by an ultrasonic dispersing device, making the dispersion concentration 3,000 particles to 10,000 particles/μl, and the shape and the distribution of the toner are determined using the above equipment.

<Process Cartridge>

Figure 4:
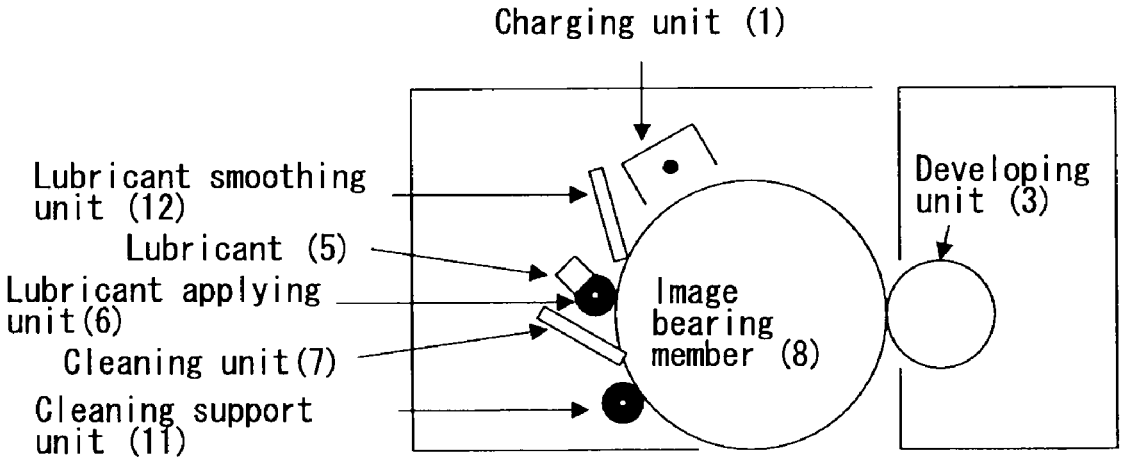
FIG. 4 is an illustration showing an example of the structure of a process cartridge.

Preferably a process cartridge is constituted as shown in FIG. 4, and is replaced from the image forming apparatus with a new process cartridge at the time of maintenance. The positioning of the image bearing member and the other members such as the cleaning blade is very important, and even a small deviation from the best positioning causes a loss of intended cleaning ability, a reduced lifetime due to a different cleaning performance between in the right part and in the left part, and an easy contamination of the other members. Therefore, usage of the process cartridge is preferable.

EXAMPLES

First, toners of examples 1 to 4 shown below were prepared.

Example 1

Into a reaction tank equipped with a condenser tube, a stirrer, and a nitrogen inlet tube, 229 parts of bisphenol A ethyleneoxide (dimolar) adduct, 529 parts of bisphenol A propionoxide (trimolar) adduct, 208 parts of terephthalic acid, 46 parts of adipic acid, and 2 parts of dibutyl tin oxide were poured, and were reacted under a normal pressure at 230° C. for 8 hours. Then the mixture was reacted under a reduced pressure of 10 mmHg to 15 mmHg for 5 hours, 44 parts of trimellitic acid anhydride were added into the reaction tank, and an unmodified polyester resin was synthesized by subjecting the reactant to a reaction under a normal pressure at 180° C. for 2 hours.

The thus obtained unmodified polyester resin had a number average molecular weight of 2,500, a weight average molecular weight of 6,700, a glass transition temperature of 43° C., and an acid number of 25 mg KOH/g.

Using a HENSCHEL MIXER (manufactured by Mitsuikozan Co., Ltd.), 1,200 parts of water, 540 parts of carbon black PRINTEX35 (manufactured by Degussa, DBP oil absorption: 42 ml/100 g, and pH=9.5), and 1,200 parts of an unmodified polyester resin were mixed. After the mixing, the obtained mixture was kneaded at 150° C. for 30 minutes using a twin roll, the kneaded mixture was rolled, cooled, and pulverized in a pulverizer (manufactured by Hosokawa Micron Co., Ltd) to thereby prepare a masterbatch.

Into a reaction vessel equipped with a stirrer and a thermometer, 378 parts of the unmodified polyester resin, 110 parts of carnauba wax, 22 parts of salicylic acid metal complex E-84 (manufactured by Orient Chemical Industries, Ltd.), and 947 parts of ethyl acetate were poured, the components were stirred with the stirrer and the temperature of the components was raised to 80° C., after a 5-hr incubation at 80° C., the temperature of the components was decreased to 30° C. for an hour. Then, in the reaction vessel, 500 parts of the masterbatch and 500 parts of ethyl acetate were poured, and the components were mixed for an hour to thereby obtain a raw material solution.

Into the reaction vessel, 1324 parts of the raw material solution thus obtained were transferred, by using a beads mill ULTRAVISCOMILL (manufactured by Aimex Co., Ltd), the raw material solution was pulverized three times under the condition that 0.5 mm zirconia beads was charged to 80 volume %, a sending speed of the solution was of 1 kg/hr and a disk circumferential velocity was 6 ml/sec, C.I. pigment red and carnauba wax were dispersed therein to thereby obtain a wax dispersion fluid.

Next, to the wax dispersion fluid, 1324 parts of a 65 weight % ethyl acetate solution of the unmodified polyester resin were added. A dispersion fluid of toner materials was obtained, by adding 3 parts of a laminar inorganic mineral montmorillonite modified with a quaternary ammonium salt having a benzyl group at least in part ("CLAYTONE APA"; manufactured by Southern Clay Products Inc.) to 200 parts of a dispersion fluid obtained by pulverization once by using the ULTRAVISCOMILL under the same conditions as above, and by stirring the resultant mixture using T. K. HOMO DISPER (manufactured by PRIMIX Corp.) for 30 minutes.

The viscosity of the dispersion fluid of the obtained toner materials was determined as follows.

After a shear force at a shearing rate of 30,000/sec was applied to the dispersion fluid of the toner materials for 30 sec at 25° C., the viscosity (viscosity A) was determined when a shear force varied from a 0/sec shearing rate to a 70/sec shearing rate in 20 sec was applied to it, using a parallel plate type rheometer AR2000 equipped with parallel plates with a 20 mm diameter (from TA Instruments Japan Inc.) with a gap set as 30 μm. In addition, the viscosity (viscosity B) was determined when a shear force at a shearing rate of 30,000/sec was applied to the dispersion fluid of the toner materials for 30 sec at 25° C., using the parallel plate type rheometer AR2000. The result is shown in Table 1.

Into the reaction vessel equipped with a condenser tube, a stirrer, and nitrogen inlet tube, 682 parts of bisphenol A ethyleneoxide (dimolar) adduct, 81 parts of bisphenol A propyleneoxide (dimolar) adduct, 283 parts of terephthalic acid, 22 parts of trimellitic acid anhydride, and 2 parts of dibutyl tin oxide were poured, and were reacted under a normal pressure at 230° C. for 8 hours. Then the mixture was reacted under a reduced pressure of 10 mmHg to 15 mmHg for 5 hours, and an intermediate polyester resin was synthesized.

The thus obtained intermediate polyester resin had a number average molecular weight of 2,100, a weight average molecular weight of 9,500, a glass transition temperature of 55° C., an acid number of 0.5 mg KOH/g, and hydroxyl group number of 51 mg KOH/g.

Next, into the reaction vessel with a condenser tube, a stirrer, and nitrogen inlet tube, 410 parts of the intermediate polyester resin, 89 parts of isophoronediisocyanate, and 500 parts of ethyl acetate were stocked, the mixture was reacted for 5 hours at 100° C., and a prepolymer was synthesized. The free isocyanate content of the thus obtained prepolymer thus obtained was 1.53 weight %.

Into the reaction vessel set with a stirrer and thermometer, 170 parts of isophoronediamine and 75 parts of methyl ethyl ketone were stocked, the mixture was reacted for 5 hours at 50° C., and a ketimine compound was synthesized. The amine number of the thus obtained ketimine compound was 418 mg KOH/g.

Into the reaction vessel, 749 parts of the dispersion fluid of toner materials, 115 parts of the prepolymer, and 2.9 parts of the ketimine compound were stocked, and the mixture was mixed using TK HOMOMIXER (manufactured by Primix Corp.) at 5,000 rpm for one minute to obtain a oil phase liquid mixture.

Into the reaction vessel set with a stirrer and thermometer, 683 parts of water, 11 parts of a reactive emulsifier (a sodium salt of the sulfate ester of the ethyleneoxide adduct of methacrylic acid) ELEMINOL RS-30 (manufactured by Sanyo Chemical Industries, Ltd.), 83 parts of styrene, 83 parts of methacrylic acid, 110 parts of butyl acrylate, and one part of ammonium sulfate were, were stirred for 15 minutes at 400 rpm to obtain an emulsion. The emulsion was reacted for 5 hours with the temperature of the emulsion gradually raised to 75° C. by heating. Then, 30 parts of one weight % aqueous solution of ammonium persulfate were added to the emulsion, the mixture was aged for 5 hours at 75° C. to thereby prepare a resin particle dispersion fluid.

(Particle Diameter of Dispersed Particle of and Distribution of Dispersed Particle Diameter of the Toner Material Fluid)

In the present invention, for measurements of diameters and a distribution of diameters of the dispersion particles of the toner material fluid MICROTRAC UPA-150 (manufactured by NIKKISO Co., Ltd.) was used, and for the analysis thereof, analysis software MICROTRAC PARTICLE SIZE ANALYZER Ver. 10.1.2-016EE (manufactured by NIKKISO Co., Ltd.) was used. Specifically, the toner material fluid and then the solvents used for construction of the toner material fluid are poured into a 30 ml glass sample bottle, and a weight % dispersion fluid was prepared. The dispersion fluid thus obtained was subjected to a 2-min dispersion treatment using ULTRASONIC DISPERSING DEVICE W-113MK-II (manufactured by HONDA ELECTRONICS Co., LTD.).

After background information on a particle diameter distribution was measured in the solvent used for the toner material fluid to be measured, the dispersion fluid was delivered by drops into the solvent, and the dispersion particle diameter was measured under the condition that a sample loading value of the measurement device was in the range of 1 to 10. In this measurement method, it is important to measure the dispersion particle diameter under the condition that the sample loading value of the measurement device was in the range of 1 to 10, from the viewpoint of reproducibility of a measurement of the dispersion particle diameters. The amount of the drops of the dispersion fluid delivered into the solvents is required to be adjusted in order to obtain the sample loading value.

The following was conditions under which the measurement and analysis were conducted.

Unit of distribution: volume
Selected particle diameter segment: standard
Number of channels: 44
Measurement period: 60 sec
Number of measuring times: once
Particle transparency: permeable
Particle refractive index: 1.5
Particle shape: nonspherical shape
Density of toner materials: 1 g/cm$^3$ For the solvent used for the toner material fluid, ethyl acetate (the solvent refractive index=1.37, from the value described in "Sokuteiji no Nyuryoku Joken ni Kansuru Gaidorain (A Guidline for the Input Conditions at Measurement)" issued by NIKKISO CO., LTD) was used.

An aqueous medium was obtained by mixing and stirring 990 parts of water, 83 parts of the resin particle dispersion fluid, 37 parts of a 48.5 weight % aqueous solution of sodium dodecyldiphenyletherdisulfonate ELEMINOL MON-7 (manufactured by Sanyo Chemical Industries, Ltd.), 135 parts of a one weight % aqueous solution of macromolecule dispersion agent carboxymethylcellulose sodium CELLOGEN BS-H-3 (manufactured by Dai-ichi Kogyo Seiyaku Co., Ltd.), and 90 parts of ethyl acetate.

A dispersion fluid (emulsification slurry) was prepared by adding 867 parts of the oil phase liquid mixture to 1,200 parts of the aqueous medium, and by mixing for 20 minutes at 13,000 rpm using TK HOMOMIXER.

Next, into the reaction vessel set with a stirrer and thermometer the emulsification slurry was stocked, and dispersion slurry was obtained by removing the solvent from the emulsification slurry for 8 hours at 30° C. and then by aging the solvent-removed emulsification slurry for 4 hours at 45° C.

The volume average particle diameter (Dv) and number average particle diameter (Dn) of the toner of the present invention were determined using a particle size measurement device ("MULTI SIZER III", manufactured by Beckman Coulter K.K.) with an aperture diameter of 100 μm, and analyzed by analysis software (BECKMAN COULTER MULTISIZER 3 Version 3.51). Specifically, into a 100 ml glass beaker, 0.5 ml of a 10 weight % surfactant (an alkylbenzene sulfonate NEOGEN SC-A; manufactured by Dai-ichi Kogyo Seiyaku Co., Ltd.) was added, 0.5 g of each of the toners was added and stirred by a micro spatula, and then to the resultant mixture, 80 ml of an ion-exchange water was added. The dispersion fluid thus obtained was subjected to a 10 minutes dispersion treatment using an ultrasonic dispersing device (W-113MK-II manufactured by HONDA ELECTRONICS CO., LTD). The dispersion fluid was measured using the MULTISIZER III and ISOTON III (manufactured by Beckman Coulter K.K.) as a solution for measurement. In the measurement, the toner sample dispersion fluid was delivered by drops so that the concentration indicated by the device was 8±2%. In this measurement method, it is important to control the concentration of the dispersion fluid to 8±2% from the viewpoint of reproducibility of the measurement of a particle diameter. As far as the concentration is in this range, inaccuracy of the particle diameter does not occur.

After 100 parts by weight of the dispersion slurry was subjected to a vacuum filtration, the resultant filter cake to which 100 parts of an ion-exchange water was added was stirred for 10 minutes at 12,000 rpm using TK HOMOMIXER, and the resultant fluid was filtered.

To the filter cake thus obtained, 10 weight % hydrochloric acid was added so that pH of the resultant fluid was adjusted to 2.8, and the resultant fluid was agitated for 10 minutes at 12,000 rpm using TK HOMOMIXER, and filtered.

To the filter cake thus obtained, 300 parts of an ion-exchange water was added and the resultant fluid was stirred for 10 minutes at 12,000 rpm using TK HOMOMIXER and then filtered. The treatment was repeated once more and the final filter cake was obtained.

A toner base particle was obtained by drying the final filter cake thus obtained for 48 hours at 45° C. using a wind circulation drying machine, and by passing the resultant dry mass through a sieve of a 75 μm mesh opening.

A toner was produced by adding to 100 parts of the toner base particle obtained above, 1.0 part of hydrophobic silica (although in this example H2000 manufactured by Clariant (Japan) K.K. was used, H1303 and H3004 (both manufactured by Clariant (Japan) K.K.) may be used in addition to this) and 1.0 parts of hydrophobic titanium oxide (although in this example JMT150 IB manufactured by Tayca Corp. was used, MT150AI, SMT150AI as well as SMT150AFM may be used in addition to this), and by mixing using a HENSCHEL MIXER (manufactured by Mitsuikozan Co., Ltd.).

Physical properties of the toner thus obtained (example A) are shown in Table 1.

Example 2

A toner was produced in the same manner as in Example 1 except that the addition amount of the modified laminar inorganic mineral (trade name: CLAYTONE APA) was changed from 3 parts to 0.1 parts.

Physical properties of the toner thus obtained (example B) are shown in Table 1.

Example 3

A toner was produced in the same manner as in Example 1 except that a laminar inorganic mineral montmorillonite at least in part modified with an ammonium salt having a polyoxyethylene group (CLAYTONE HY manufactured by Southern Clay Products, inc.) was used instead of CLAYTONE APA.

Physical properties of the toner thus obtained (example C) are shown in Table 1.

Example 4

A toner was produced in the same manner as in Example 1 except that the addition amount of CLAYTONE APA was changed from 3 parts to 5 parts.

Physical properties of the toner thus obtained (example D) are shown in Table 1.

Next, the toners of the Comparative Examples 1 to 5 were produced as follows.

Comparative Example 1

A toner was produced in the same manner as in Example 1 except that CLAYTONE APA was not added.

Physical properties of the toner thus obtained (comparative example A) are shown in Table 1.

Comparative Example 2

A toner was produced in the same manner as in Example 1 except that the addition amount of CLAYTONE APA was changed from 3 parts to 6 parts.

Physical properties of the toner thus obtained (comparative example B) are shown in Table 1.

Comparative Example 3

A toner was produced in the same manner as in Example 1 except that an unmodified laminar inorganic mineral montmorillonite (the trade name: KUNIPIA, manufactured by KUNIMINE INDUSTRIES CO., LTD) was used instead of CLAYTONE APA (manufactured by Southern Clay Products Inc.).

Physical properties of the toner thus obtained (comparative example C) are shown in Table 1.

Comparative Example 4

A toner was produced in the same manner as in Example 1 except that only 1.0 part of hydrophobic silica was added to 100 parts of the toner base particle with a mix treatment using a HENSCHEL MIXER (manufactured by Mitsuikozan Co., Ltd.).

Physical properties of the toner thus obtained (comparative example D) are shown in Table 1. However, since this toner had a poor flowability from the initial period and could not be supplied sufficiently by IMAGIO NEO C600, the experiment could not be accomplished and was stopped.

<Evaluation of Image Quality>

Next, to the toners of the examples and comparative examples obtained above, an inorganic fine particle was externally added with a change in formulation, and the image quality when these toners were used was evaluated.

The evaluation method was described below.

Image bearing members used in the test were the image bearing members described in the above which inorganic fine particles were dispersed on the surface.

Figure 5:
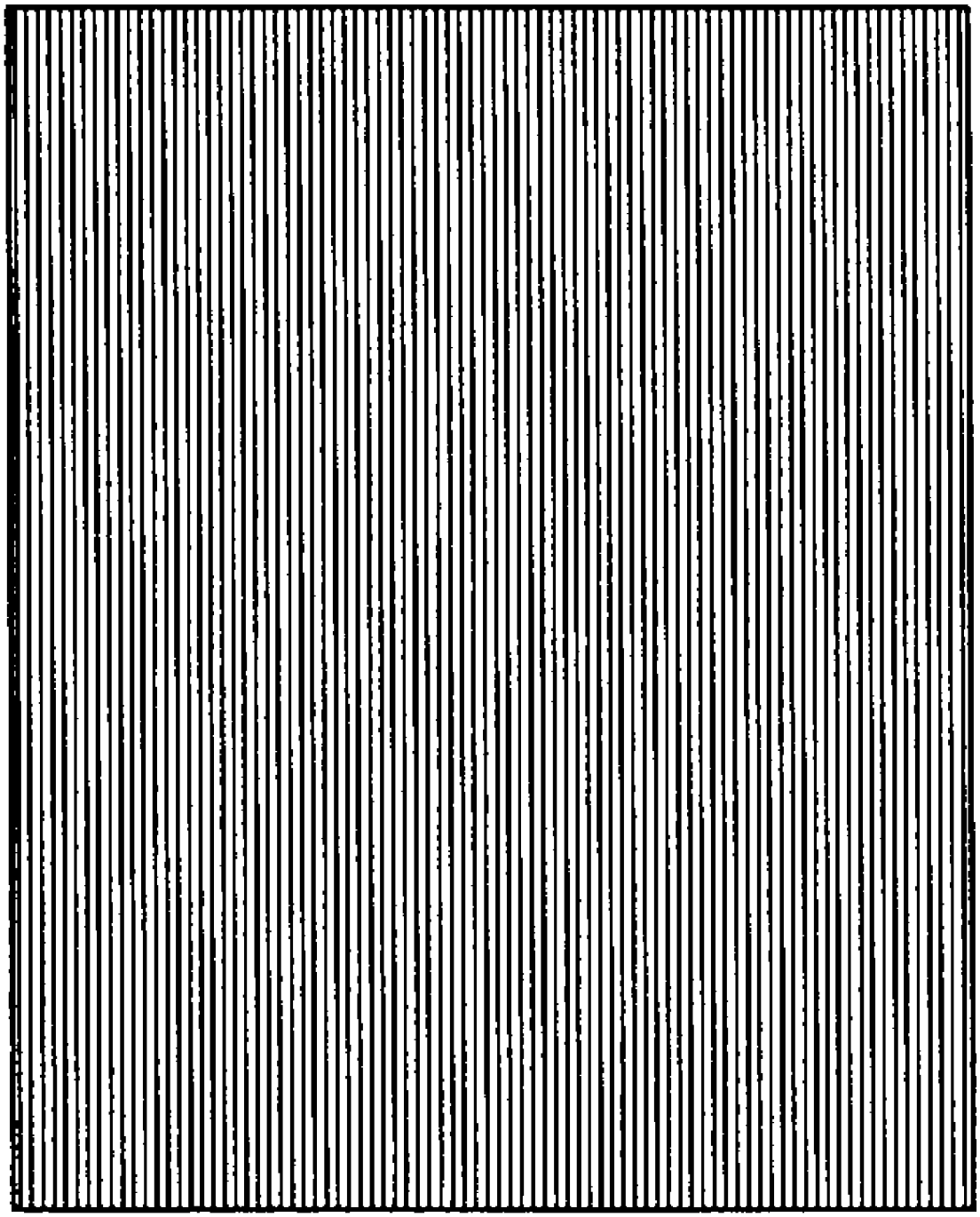
FIG. 5 is an illustration showing a printing chart used in the experiment.

1. All of the sample toners and apparatuses used for the test were left for one day in an environmental chamber of a 25° C. temperature and 50% humidity.
2. In the PCU of a commercialized product of IMAGIO NEO C600, all the toner was removed from the developer taken out from the developing unit to thereby obtain 400 g of a carrier.
3. To the carrier, 28 g of the toner as a sample was added, and 400 g of a developer of a 7% toner concentration was prepared.
4. The developer thus obtained was put into the PCU of IMAGIO NEO C600, and the developing device alone was idled for 5 minutes at a 300 mm/sec linear speed of the developing sleeve.
5. The developing sleeve and the photoconductor were rotated in trailing way at 300 mm/s, and the charged potential and developing bias were adjusted so that the toner on the photoconductor was 0.4±0.05 mg/cm$^2$.
6. Under the conditions described above, an image of thin lines in an A3 size paper as shown in FIG. 5 was prepared, and 10,000 sheets of the A3 size paper with the image were printed.
7. The 10,000th printed image was taken as a sample and thin line reproducibility was evaluated visually. When the image of the thin lines was judged as a normal image, the toner was evaluated as "OK" and ranked as "A", and when the image was judged as an abnormal image the toner was evaluated as "NG" and ranked as "B".
8. The above test was carried out for each of the obtained toners.

<Results of Evaluation>

The results of the evaluation are shown in Table 1.

In these test results, comparative examples A, B, C, and D were judged as abnormal images, and it was made clear that the toner flowability could not be maintained.

Furthermore, the result of the comparative example A was judged as NG because the shape of the toner was too spherical to prevent occurrence of abnormal images due to a cleaning defect.

For the comparative example B, the result of evaluation was NG and it was made clear that the comparative example B was unsuitable in practical use.

And it was made clear that the comparative example D could not be used practically.

TABLE 1

| Example No/ Comparative Example No. | Ex. 1 | Ex. 2 | Ex. 3 | Ex. 4 | Comp. Ex. 1 | Comp. Ex. 2 | Comp. Ex. 3 | Comp. Ex. 4 |
|---|---|---|---|---|---|---|---|---|
| Name of toner | ex. A | ex. B | ex. C | ex. D | comp. ex. A | comp. ex. B | comp. ex. C | comp. ex. D |
| Modified laminar inorganic mineral | Added | Added | Added | Added | Not added | Added | Not added | Added |
| External additive*1) | silica, titanium oxide | silica, titanium oxide | silica, titanium oxide | silica, titanium oxide | silica, titanium oxide | silica, titanium oxide | silica, titanium oxide | silica |
| Aspect ratio | 0.85 | 0.89 | 0.86 | 0.81 | 0.92 | 0.79 | 0.76 | 0.85 |
| Content of particle having diameter ≦2.0 μm | 9.7 | 6.5 | 5.4 | 8.9 | 1.3 | 4.3 | 8.4 | 9.7 |
| Volume average particle diameter (Dv) | 5.3 | 5.5 | 5.0 | 5.2 | 5.4 | 5.5 | 5.4 | 5.3 |
| Number average particle diameter (Dn) | 4.6 | 4.4 | 4.3 | 4.2 | 4.9 | 4.3 | 3.5 | 4.6 |

TABLE 1-continued

| Example No/ Comparative Example No. | Ex. 1 | Ex. 2 | Ex. 3 | Ex. 4 | Comp. Ex. 1 | Comp. Ex. 2 | Comp. Ex. 3 | Comp. Ex. 4 |
|---|---|---|---|---|---|---|---|---|
| Dv/Dn | 1.16 | 1.25 | 1.16 | 1.24 | 1.10 | 1.28 | 1.42 | 1.16 |
| Visual check result of thin line reproducibility | A | A | A | A | B | B | B | — |

*1)Silica and titanium oxide described in this Table indicate hydrophobized silica and titanium oxide, respectively.

INDUSTRIAL APPLICABILITY

Since the toner according to the present invention is capable of producing high quality images stably with time without causing a phenomenon of missing the central part of a thin line and with an appropriate flowability of the toner, when the toner degrades with time and when the external additives are buried or detached, the toner according to the present invention is preferable as a toner used in image forming apparatuses such as copiers and printers.

What is claimed is:

1. A toner used in an image forming apparatus, comprising:

a binder resin, a colorant, and a laminar inorganic mineral in which at least part of an ion in layers is modified with an organic ion, wherein the toner is granulated in an aqueous system, the volume average particle diameter Dv of the toner is in the range of 3.0 μm<Dv<6.5 μm, the aspect ratio of the toner is 0.81 to 0.89, and the surface of the toner is externally added with a plurality of types of fine particles.

2. The toner according to claim 1, wherein the ion in the layers of the laminar inorganic mineral is a metal cation and the organic ion is an organic cation.

3. The toner according to claim 1, wherein the ratio of the volume average particle diameter (Dv) to the number average particle diameter (Dv/Dn) is in the range of 1.00 to 1.40.

4. The toner according to claim 1, wherein the content of a particle of 2 μm or less in diameter is 1% by number to 10% by number.

5. An image forming apparatus, comprising an image bearing member, a charging unit configured to charge the surface of the image bearing member, an exposing unit configured to imagewisely expose the surface of the image bearing member to write a latent image on the image bearing member, a developing unit configured to develop the latent image written on the image bearing member with a toner, a transfer unit configured to transfer the developed toner image onto an intermediate transfer member or to a printing paper, and a cleaning unit configured to remove an untransferred residual toner remaining on the image bearing member, wherein the toner used in development on the image bearing member by the developing unit is a toner which comprises a binder resin, a colorant, and a laminar inorganic mineral in which at least part of an ion in layers is modified with an organic ion, the toner is granulated in an aqueous system, the volume average particle diameter Dv of the toner is in the range of 3.0 μm<Dv<6.5 μm, the aspect ratio of the toner is 0.81 to 0.89, and the surface of the toner is externally added with a plurality of types of fine particles.

6. The image forming apparatus according to claim 5, wherein a toner image is transferred at least twice during the period from the time when the latent image is developed on the surface of the image bearing member with toner to the time when the printing paper onto which the toner image is transferred is passed through a fixing unit.

7. A process cartridge comprising:

a developing unit, and at least one unit selected from the group consisting of an image bearing member, a charging unit, and a cleaning unit, which are integrated into one unit, wherein the process cartridge is detachably mounted to a main body of an image forming apparatus, the toner used in development on the image bearing member by the developing unit is a toner which comprises a binder resin, a colorant, and a laminar inorganic mineral in which at least part of an ion in layers is modified with an organic ion, the toner is granulated in an aqueous system, the volume average particle diameter Dv of the toner is in the range of 3.0 μm<Dv<6.5 μm, the aspect ratio of the toner is 0.81 to 0.89, and the surface of the toner is externally added with a plurality of types of fine particles.

* * * * *